US007930184B2

(12) United States Patent
Fejzo

(10) Patent No.: US 7,930,184 B2
(45) Date of Patent: Apr. 19, 2011

(54) MULTI-CHANNEL AUDIO CODING/DECODING OF RANDOM ACCESS POINTS AND TRANSIENTS

(75) Inventor: Zoran Fejzo, Los Angeles, CA (US)

(73) Assignee: DTS, Inc., Calabasas, CA (US)

( * ) Notice: Subject to any disclaimer, the term of this patent is extended or adjusted under 35 U.S.C. 154(b) by 660 days.

(21) Appl. No.: 12/011,899

(22) Filed: Jan. 30, 2008

(65) Prior Publication Data

US 2008/0215317 A1 Sep. 4, 2008

Related U.S. Application Data

(63) Continuation-in-part of application No. 10/911,067, filed on Aug. 4, 2004, now Pat. No. 7,392,195.

(51) Int. Cl.
*G10L 19/04* (2006.01)

(52) U.S. Cl. ..... 704/500; 704/216; 704/219; 381/2; 370/470

(58) Field of Classification Search ..... 704/201, 704/219, 229, 500, 501, 216; 381/1, 2; 370/470
See application file for complete search history.

(56) References Cited

U.S. PATENT DOCUMENTS

| | | | | |
|---|---|---|---|---|
| 6,023,233 | A | 2/2000 | Craven | |
| 6,226,616 | B1 | 5/2001 | You | |
| 6,784,812 | B2 | 8/2004 | Craven | |
| 7,272,567 | B2 * | 9/2007 | Fejzo | 704/500 |
| 7,392,195 | B2 * | 6/2008 | Fejzo | 704/500 |
| 7,460,993 | B2 * | 12/2008 | Chen et al. | 704/230 |
| 7,668,723 | B2 * | 2/2010 | Fejzo | 704/500 |
| 7,689,427 | B2 * | 3/2010 | Vasilache | 704/500 |
| 2003/0018884 | A1 * | 1/2003 | Wise et al. | 712/300 |
| 2004/0196913 | A1 * | 10/2004 | Chakravarthy et al. | 375/254 |
| 2005/0198346 | A1 * | 9/2005 | Wang et al. | 709/231 |
| 2007/0094027 | A1 * | 4/2007 | Vasilache | 704/257 |
| 2008/0059202 | A1 * | 3/2008 | You | 704/500 |
| 2009/0164223 | A1 * | 6/2009 | Fejzo | 704/500 |

(Continued)

FOREIGN PATENT DOCUMENTS

EP 0955731 A2 11/1999

(Continued)

OTHER PUBLICATIONS

Fejzo et al., "DTS-HD: Technical Overview of Lossless Mode of Operation", Audio Engineering Society (AES) 118th Convention, Barcelona, Spain, May 28-31, 2005, pp. 1 to 15.*

(Continued)

*Primary Examiner* — Martin Lerner
(74) *Attorney, Agent, or Firm* — William L. Johnson; Guarav K. Mohindra; Eric A. Gifford

(57) ABSTRACT

A lossless audio codec encodes/decodes a lossless variable bit rate (VBR) bitstream with random access point (RAP) capability to initiate lossless decoding at a specified segment within a frame and/or multiple prediction parameter set (MPPS) capability partitioned to mitigate transient effects. This is accomplished with an adaptive segmentation technique that fixes segment start points based on constraints imposed by the existence of a desired RAP and/or detected transient in the frame and selects a optimum segment duration in each frame to reduce encoded frame payload subject to an encoded segment payload constraint. In general, the boundary constraints specify that a desired RAP or detected transient must lie within a certain number of analysis blocks of a segment start point.

50 Claims, 18 Drawing Sheets

U.S. PATENT DOCUMENTS

| | | | | |
|---|---|---|---|---|
| 2009/0164224 | A1* | 6/2009 | Fejzo | 704/500 |
| 2010/0082352 | A1* | 4/2010 | Fejzo | 704/500 |

FOREIGN PATENT DOCUMENTS

| | | | |
|---|---|---|---|
| EP | 1054514 | A1 | 9/2007 |
| WO | WO 00/74038 | A1 | 12/2000 |
| WO | WO00/79520 | A1 | 12/2000 |
| WO | WO03/077235 | A1 | 1/2008 |

OTHER PUBLICATIONS

Grant Notice Issued in Russian Counter-Part Application No. 2006137573; Filed: Oct. 24, 2006.

Supplementary European Search Report Issued in Corresponding European Patent Application No. EP 05731220, Filed Mar. 21, 2005.

Liebchen T et al: "MPEG-4 ALS: an emerging standard for lossless audio coding" Data Compression Conference, 2004. Proceedings. DCC 2004 Snowbird, UT, USA Mar. 23-25, 2004 Piscataway, NJ, USA IEEE, Mar. 23, 2004. pp. 439-448, XP010692571.

Liebchen T: "Lossless Audio Coding using Adaptive Multichannel Prediction" Internet Citation Oct. 5, 2002, XP002466533. p. 5.

Liebchen T et al: "Lossless Transform Coding of Audio Signals" Digital Audio: From Lossless to Transparent Coding, IEEE Signal Processing Workshop Jan. 1, 1997, XP000926390. pp. 1-10.

* cited by examiner

If AllChSameParamFlag == true
- single RiceCodeFlag is transmitted per channel set
- single CodeParam is transmitted per channel set
Else
- RiceCodeFlag is transmitted for each channel in the channel set
- CodeParam is transmitted for each channel in the channel set

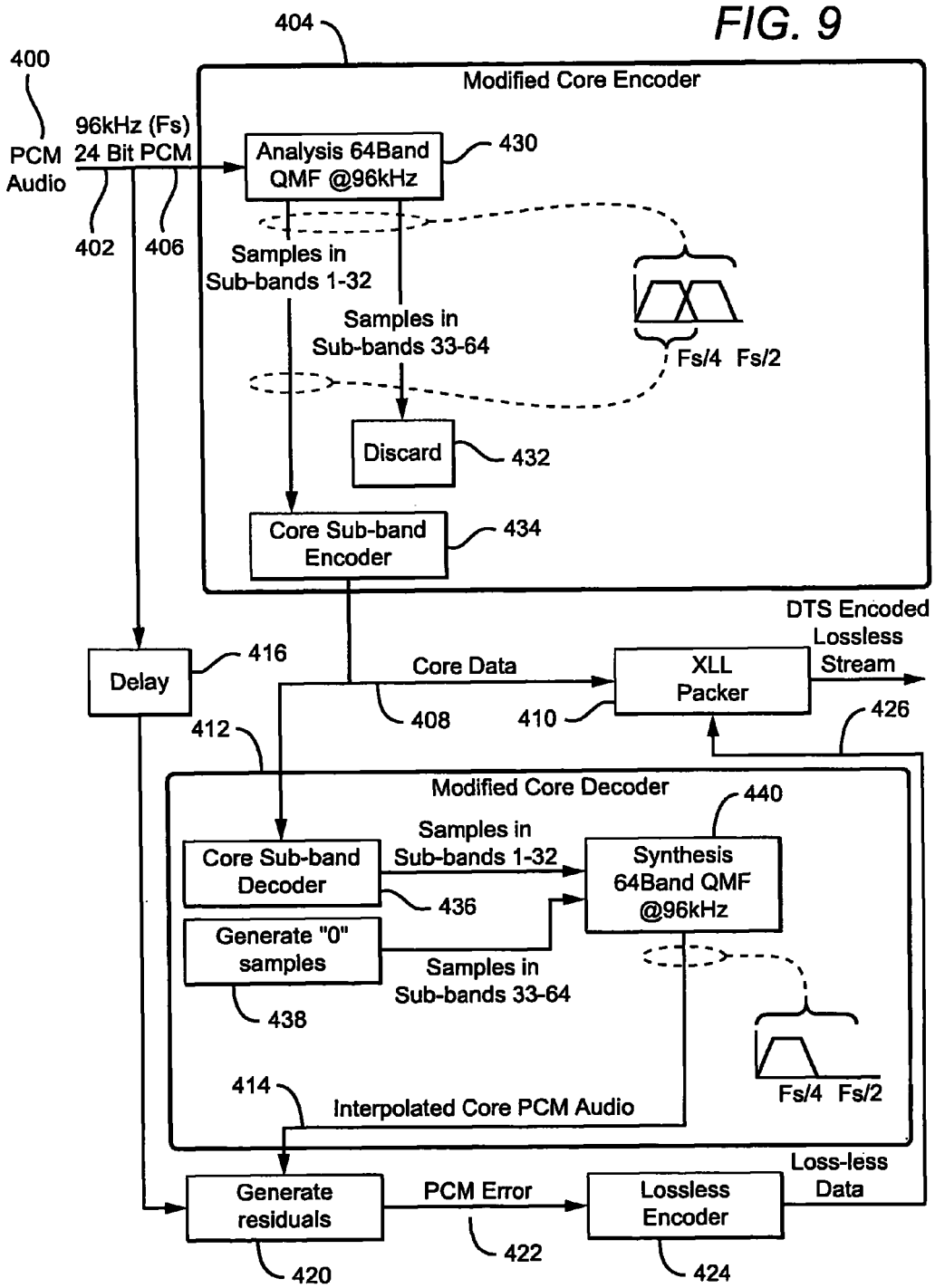
FIG. 9
400
PCM Audio
96kHz (Fs)
24 Bit PCM
402
406
404
Modified Core Encoder
Analysis 64Band QMF @96kHz
430
Samples in Sub-bands 1-32
Samples in Sub-bands 33-64
Fs/4 Fs/2
Discard
432
Core Sub-band Encoder
434
Delay
416
Core Data
408
410
XLL Packer
DTS Encoded Lossless Stream
426
412
Modified Core Decoder
440
Core Sub-band Decoder
Samples in Sub-bands 1-32
436
Synthesis 64Band QMF @96kHz
Generate "0" samples
Samples in Sub-bands 33-64
438
Fs/4 Fs/2
414
Interpolated Core PCM Audio
Generate residuals
PCM Error
Lossless Encoder
Loss-less Data
420
422
424

NAVI ChSet_0 Payload Size FSIZE_ChSet_0
NAVI ChSet_N-1 Payload Size FSIZE_ChSet_N-1
520

NAVI Segment 0
NAVI Segment M-1
518
$SEG_0_FSIZE = \sum_{n=0}^{N-1} FSIZE_ChSet_n$
NAVI Chunk
CRC16
514
516
506
508
510
512
SYNC
Common
SUB-HEADER ChSET0
SUB-HEADER ChSET(N-1)
NAVI
502
HEADER
504
502
HEADER XL
SEG0
SEGK
SEG(M-1)
500
SEGK_Byte_Offset
$SEG_K_Byte_Offset = \sum_{i=0}^{k-1} Seg_i_FSIZE$
522
ChSET0
ChSET1
ChSET(N-1)
504
SEGMENT

FIG. 11a

530

```
Common Header Information
RAP Flag = TRUE if RAP
RAP ID = Segment # of RAP
```

532

```
Channel Set Header Information

NumChannelsInChSet - Number of channels in a channel set

For all channels indexed ch=0, . . . NumChannelsInChSet -1:

AdPredOrder[0][ch] -order of Adaptive Predictor for channel ch
If AdPredOrder[0][ch] = 0
  FixedPredOrder[0][ch] - order of Fixed Predictor for channel CH
ELSE
  AdPredCodes[0] [chj [AdPredOrder[0] [ch]] - Adaptive Prediction Codes
  Consisting of AdPredOrder[0] [ch] distinct codes for channel ch
ENDIF

ExtraPredSetsPresent[ch] = TRUE if Transient present in channel ch
If ExtraPredSetsPresent[ch]==TRUE
  StartSegment[ch] = index indicating the transient start segment for a channel ch
  AdPredOrder[1] [ch] -order of Adaptive Predictor for channel ch
  If AdPredOrder[1] [ch] = 0
      FixedPredOrder[1][ch] - order of Fixed Predictor for channel CH
  ELSE
      AdPredCodes[1] [ch][AdPredOrder[1][ch]] - Adaptive Prediction Codes
      Consisting of AdPredOrder[1][ch] distinct codes for channel ch
  ENDIF
ENDIF
```

FIG. 11b

Constrained Segment Duration
RAP Max duration = 8 ABs
CH 1 max = 4 ABs
CH 2 max = 1 AB, if 2nd AB OK than 16

Pick Max Frame Duration = 4 x AB_dur.

Unconstrained Segment Duration
Segment Start 1: 1st segment
Segment Start 2: 5th segment
Segment Start 3: 9th segment
Segment Start 4: 18th segment FIG. 15a
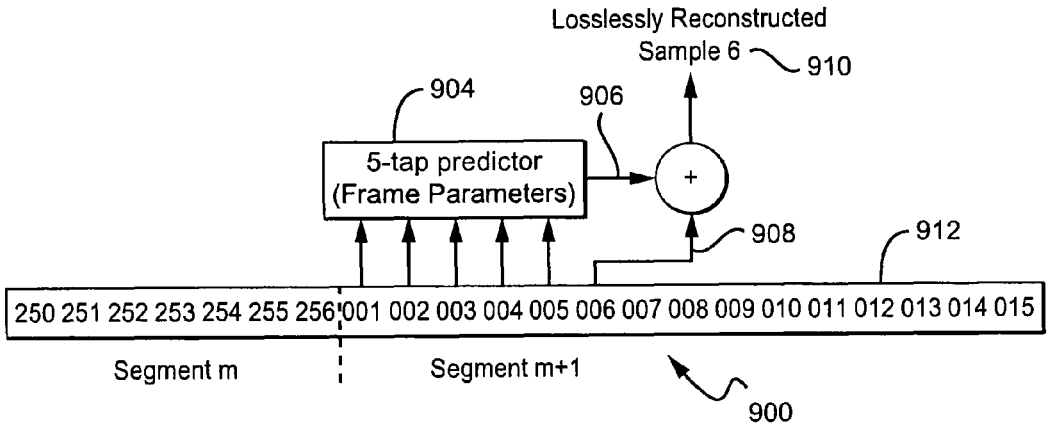
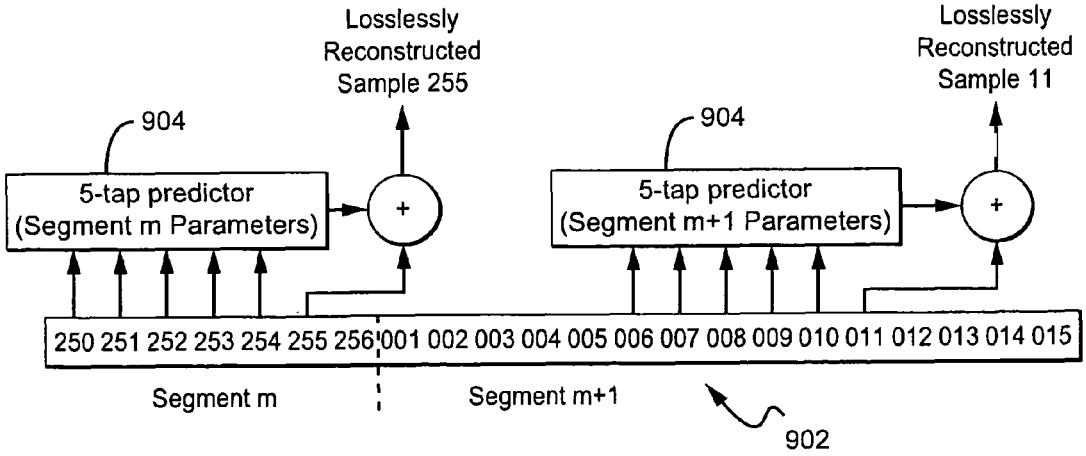
FIG. 15b

MULTI-CHANNEL AUDIO CODING/DECODING OF RANDOM ACCESS POINTS AND TRANSIENTS

CROSS-REFERENCE TO RELATED APPLICATIONS

This application claims benefit of priority under 35 U.S.C. 120 as a continuation-in-part (CIP) of Ser. No. 10/911,067 filed Aug. 4, 2004 now U.S. Pat. No. 7,392,195 issued Jun. 24, 2008, the entire contents of which are incorporated by reference.

BACKGROUND OF THE INVENTION

1. Field of the Invention

This invention relates to lossless audio codecs and more specifically to a lossless multi-channel audio codec using adaptive segmentation with random access point (RAP) capability and multiple prediction parameter set (MPPS) capability.

2. Description of the Related Art

Numbers of low bit-rate lossy audio coding systems are currently in use in a wide range of consumer and professional audio playback products and services. For example, Dolby AC3 (Dolby digital) audio coding system is a world-wide standard for encoding stereo and 5.1 channel audio sound tracks for Laser Disc, NTSC coded DVD video, and ATV, using bit rates up to 640 kbit/s. MPEG I and MPEG II audio coding standards are widely used for stereo and multi-channel sound track encoding for PAL encoded DVD video, terrestrial digital radio broadcasting in Europe and Satellite broadcasting in the US, at bit rates up to 768 kbit/s. DTS (Digital Theater Systems) Coherent Acoustics audio coding system is frequently used for studio quality 5.1 channel audio sound tracks for Compact Disc, DVD video, Satellite Broadcast in Europe and Laser Disc and bit rates up to 1536 kbit/s.

Recently, many consumers have shown interest in these so-called "lossless" codecs. "Lossless" codecs rely on algorithms which compress data without discarding any information and produce a decoded signal which is identical to the (digitized) source signal. This performance comes at a cost: such codecs typically require more bandwidth than lossy codecs, and compress the data to a lesser degree.

FIG. 1 is a block diagram representation of the operations involved in losslessly compressing a single audio channel. Although the channels in multi-channel audio are generally not independent, the dependence is often weak and difficult to take into account. Therefore, the channels are typically compressed separately. However, some coders will attempt to remove correlation by forming a simple residual signal and coding (Ch1, Ch1-CH2). More sophisticated approaches take, for example, several successive orthogonal projection steps over the channel dimension. All techniques are based on the principle of first removing redundancy from the signal and then coding the resulting signal with an efficient digital coding scheme. Lossless codecs include MPL (DVD Audio), Monkey's audio (computer applications), Apple lossless, Windows Media Pro lossless, AudioPak, DVD, LTAC, MUSICcompress, OggSquish, Philips, Shorten, Sonarc and WA. A review of many of these codecs is provided by Mat Hans, Ronald Schafer "Lossless Compression of Digital Audio" Hewlett Packard, 1999.

Framing 10 is introduced to provide for editability, the sheer volume of data prohibits repetitive decompression of the entire signal preceding the region to be edited. The audio signal is divided into independent frames of equal time duration. This duration should not be too short, since significant overhead may result from the header that is prefixed to each frame. Conversely, the frame duration should not be too long, since this would limit the temporal adaptivity and would make editing more difficult. In many applications, the frame size is constrained by the peak bit rate of the media on which the audio is transferred, the buffering capacity of the decoder and desirability to have each frame be independently decodable.

Intra-channel decorrelation 12 removes redundancy by decorrelating the audio samples in each channel within a frame. Most algorithms remove redundancy by some type of linear predictive modeling of the signal. In this approach, a linear predictor is applied to the audio samples in each frame resulting in a sequence of prediction error samples. A second, less common, approach is to obtain a low bit-rate quantized or lossy representation of the signal, and then losslessly compress the difference between the lossy version and the original version. Entropy coding 14 removes redundancy from the error from the residual signal without losing any information. Typical methods include Huffman coding, run length coding and Rice coding. The output is a compressed signal that can be losslessly reconstructed.

The existing DVD specification and the preliminary HD DVD specification set a hard limit on the size of one data access unit, which represents a part of the audio stream that once extracted can be fully decoded and the reconstructed audio samples sent to the output buffers. What this means for a lossless stream is that the amount of time that each access unit can represent has to be small enough that the worst case of peak bit rate, the encoded payload does not exceed the hard limit. The time duration must be also be reduced for increased sampling rates and increased number of channels, which increase the peak bit rate.

To ensure compatibility, these existing coders will have to set the duration of an entire frame to be short enough to not exceed the hard limit in a worst case channel/sampling frequency/bit width configuration. In most configurations, this will be overkill and may seriously degrade compression performance. Furthermore, this worst case approach does not scale well with additional channels.

SUMMARY OF THE INVENTION

The present invention provides an audio codec that generates a lossless variable bit rate (VBR) bitstream with random access point (RAP) capability to initiate lossless decoding at a specified segment within a frame and/or multiple prediction parameter set (MPPS) capability partitioned to mitigate transient effects.

This is accomplished with an adaptive segmentation technique that determines segment start points to ensure boundary constraints on segments imposed by the existence of a desired RAP and/or one or more transients in the frame and selects a optimum segment duration in each frame to reduce encoded frame payload subject to an encoded segment payload constraint. In general, the boundary constraints specify that a desired RAP or transient must lie within a certain number of analysis blocks of the start of a segment. In an exemplary embodiment in which segments within a frame are of the same duration and a power of two of the analysis block duration, a maximum segment duration is determined to ensure the desired conditions are met. RAP and MPPS are particularly applicable to improve overall performance for longer frame durations.

In an exemplary embodiment, a lossless VBR audio bitstream is encoded with RAPs (RAP segments) aligned to within a specified tolerance of desired RAPs provided in an encoder timing code. Each frame is blocked into a sequence of analysis blocks with each segment having a duration equal to that of one or more analysis blocks. In each successive frame up to one RAP analysis block is determined from the timing code. The location of the RAP analysis block and a constraint that the RAP analysis block must lie within M analysis blocks of the start of the RAP segment fixes a start of a RAP segment. Prediction parameters are determined for the frame, two sets of parameters (per channel) if MPPS is enabled and a transient is detected in a channel. The samples in the audio frame are compressed with the prediction being disabled for the first samples up to the prediction order following the start of the RAP segment. Adaptive segmentation is employed on the residual samples to determine a segment duration and entropy coding parameters for each segment to minimize the encoded frame payload subject to the fixed start of the RAP segment and the encoded segment payload constraints. RAP parameters indicating the existence and location of the RAP segment and navigation data are packed into the header. In response to a navigation command to initiate playback such as user selection of a scene or surfing, the decoder unpacks the header of the next frame in the bitstream to read the RAP parameters until a frame including a RAP segment is detected. The decoder extracts segment duration and navigation data to navigate to the start of the RAP segment. The decoder disables prediction for the first samples until a prediction history is reconstructed and then decodes the remainder of the segments and subsequent frames in order, disabling the predictor each time a RAP segment is encountered. This construct allows a decoder to initiate decoding at or very near encoder-specified RAPs with a sub-frame resolution. This is particularly useful with longer frame durations when trying to sync audio playback to a video timing code that specifies RAPs at, for example, the beginning of chapters.

In another exemplary embodiment, a lossless VBR audio bitstream is encoded with MPPSs partitioned so that detected transients are located within the first L analysis blocks of a segment in their respective channels. In each successive frame up to one transient per channel per channel set and its location within the frame is detected. Prediction parameters are determined for each partition considering the segment start point(s) imposed by the transient(s). The samples in each partition are compressed with the respective parameter set. Adaptive segmentation is employed on the residual samples to determine a segment duration and entropy coding parameters for each segment to minimize the encoded frame payload subject to the segment start constraints imposed by the transient(s) (and RAP) and the encoded segment payload constraints. Transient parameters indicating the existence and location of the first transient segment (per channel) and navigation data are packed into the header. A decoder unpacks the frame header to extract the transient parameters and additional set of prediction parameters. For each channel in a channel set, the decoder uses the first set of prediction parameters until the transient segment is encountered and switches to the second set for the remainder of the segment. Although the segmentation of the frame is the same across channels and multiple channel sets, the location of a transient (if any) may vary between sets and within sets. This construct allows a decoder to switch prediction parameter sets at or very near the onset of detected transients with a sub-frame resolution. This is particularly useful with longer frame durations to improve overall coding efficiency.

Compression performance may be further enhanced by forming M/2 decorrelation channels for M-channel audio. The triplet of channels (basis, correlated, decorrelated) provides two possible pair combinations (basis, correlated) and (basis, decorrelated) that can be considered during the segmentation and entropy coding optimization to further improve compression performance. The channel pairs may be specified per segment or per frame. In an exemplary embodiment, the encoder frames the audio data and then extracts ordered channel pairs including a basis channel and a correlated channel and generates a decorrelated channel to form at least one triplet (basis, correlated, decorrelated). If the number of channels is odd, an extra basis channel is processed. Adaptive or fixed polynomial prediction is applied to each channel to form residual signals. For each triplet, the channel pair (basis, correlated) or (basis, decorrelated) with the smallest encoded payload is selected. Using the selected channel pair, a global set of coding parameters can be determined for each segment over all channels. The encoder selects the global set or distinct sets of coding parameters based on which has the smallest total encoded payload (header and audio data).

In either approach, once the optimal set of coding parameters and channel pairs for the current partition (segment duration) have been determined, the encoder calculates the encoded payload in each segment across all channels. Assuming the constraints on segment start and maximum segment payload size for any desired RAPs or detected transients are satisfied, the encoder determines whether the total encoded payload for the entire frame for the current partition is less than the current optimum for an earlier partition. If true, the current set of coding parameters and encoded payload is stored and the segment duration is increased. The segmentation algorithm suitably starts by partitioning the frame into the minimum segment sizes equal to the analysis block size and increases the segment duration by a power of two at each step. This process repeats until either the segment size violates the maximum size constraint or the segment duration grows to the maximum segment duration. The enablement of the RAP or MPPS features and the existence of a desired RAP or detected transient within a frame may cause the adaptive segmentation routine to choose a smaller segment duration than it otherwise would.

These and other features and advantages of the invention will be apparent to those skilled in the art from the following detailed description of preferred embodiments, taken together with the accompanying drawings, in which:

BRIEF DESCRIPTION OF THE DRAWINGS

FIG. 9 is a block diagram of a core plus lossless extension codec;

FIGS. 11*a* and 11*b* are diagrams of additional header information related to the specification of RAPs and MPPSs;

FIGS. 15*a* and 15*b* are diagrams illustrating the bitstream and decoding of the bitstream at a RAP segment and a transient.

DETAILED DESCRIPTION OF THE INVENTION

The present invention provides an adaptive segmentation algorithm that generates a lossless variable bit rate (VBR) bitstream with random access point (RAP) capability to initiate lossless decoding at a specified segment within a frame and/or multiple prediction parameter set (MPPS) capability partitioned to mitigate transient effects. The adaptive segmentation technique determines and fixes segment start points to ensure that boundary conditions imposed by desired RAPs and/or detected transients are met and selects a optimum segment duration in each frame to reduce encoded frame payload subject to an encoded segment payload constraint and the fixed segment start points. In general, the boundary constraints specify that a desired RAP or transient must lie within a certain number of analysis blocks of the start of a segment. The desired RAP can be plus or minus the number of analysis blocks from the segment start. The transient lies within the first number of analysis blocks of the segment. In an exemplary embodiment in which segments within a frame are of the same duration and a power of two of the analysis block duration, a maximum segment duration is determined to ensure the desired conditions. RAP and MPPS are particularly applicable to improve overall performance for longer frame durations.

Lossless Audio Codec

Figure 1:
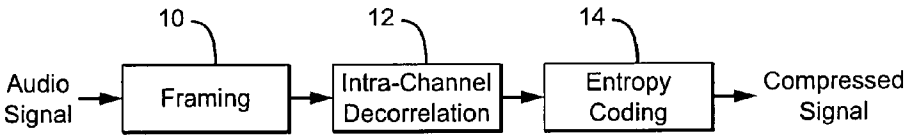
FIG. 1 PRIOR ART
FIG. 1, as described above, is a block diagram for a standard lossless audio encoder.
Figure 2A:
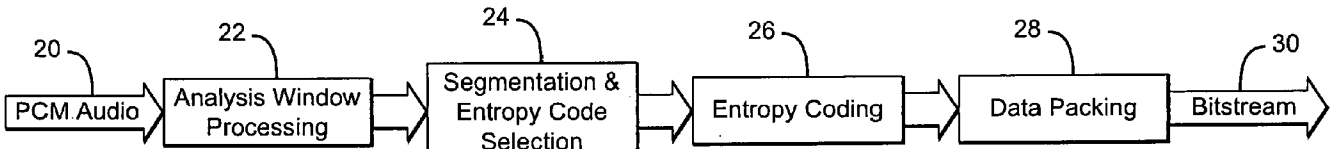
FIGS. 2*a* and 2*b* are block diagrams of a lossless audio encoder and decoder, respectively, in accordance with the present invention.
Figure 2B:
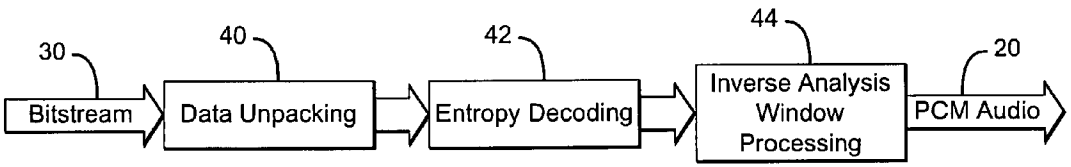

As shown in FIGS. 2*a* and 2*b*, the essential operational blocks are similar to existing lossless encoders and decoders with the exception of modifications to the analysis windows processing to set segment start conditions for RAPs and/or transients and the segmentation and entropy code selection. An analysis windows processor subjects the multi-channel PCM audio 20 to analysis window processing 22, which blocks the data in frames of a constant duration, fixes segment start points based on desired RAPs and/or detected transients and removes redundancy by decorrelating the audio samples in each channel within a frame. Decorrelation is performed using prediction, which is broadly defined to be any process that uses old reconstructed audio samples (the prediction history) to estimate a value for a current original sample and determine a residual. Prediction techniques encompass fixed or adaptive and linear or non-linear among others. Instead of entropy coding the residual signals directly, an adaptive segmentor performs an optimal segmentation and entropy code selection process 24 that segments the data into a plurality of segments and determines the segment duration and coding parameters, e.g., the selection of a particular entropy coder and its parameters, for each segment that minimizes the encoded payload for the entire frame subject to the constraint that each segment must be fully and losslessly decodable, less than a maximum number of bytes less than the frame size, less than the frame duration, and that any desired RAP and/or detected transient must lie within a specified number of analysis blocks (sub-frame resolution) from a the start of a segment. The sets of coding parameters are optimized for each distinct channel and may be optimized for a global set of coding parameters. An entropy coder entropy codes 26 each segment according to its particular set of coding parameters. A packer packs 28 encoded data and header information into a bitstream 30.

As shown in FIG. 2*b*, to perform the decode operation, the decoder navigates to a point in the bitstream 30 in response to, for example, user selection of a video scene or chapter or user surfing, and an unpacker unpacks the bitstream 40 to extract the header information and encoded data. The decoder unpacks header information to determine the next RAP segment at which decoding can begin. The decoder then navigates to the RAP segment and initiates decoding. The decoder disables prediction for a certain number of samples as it encounters each RAP segment. If the decoder detects the presence of transient in a frame, the decoder uses a first set of prediction parameters to decode a first partition and then uses a second set of prediction parameters to decode from the transient forward within the frame. An entropy decoder performs an entropy decoding 42 on each segment of each channel according to the assigned coding parameters to losslessly reconstruct the residual signals. An inverse analysis windows processor subjects these signals to inverse analysis window processing 44, which performs inverse prediction to losslessly reconstruct the original PCM audio 20.

Bit Stream Navigation and Header Format

Figure 10:
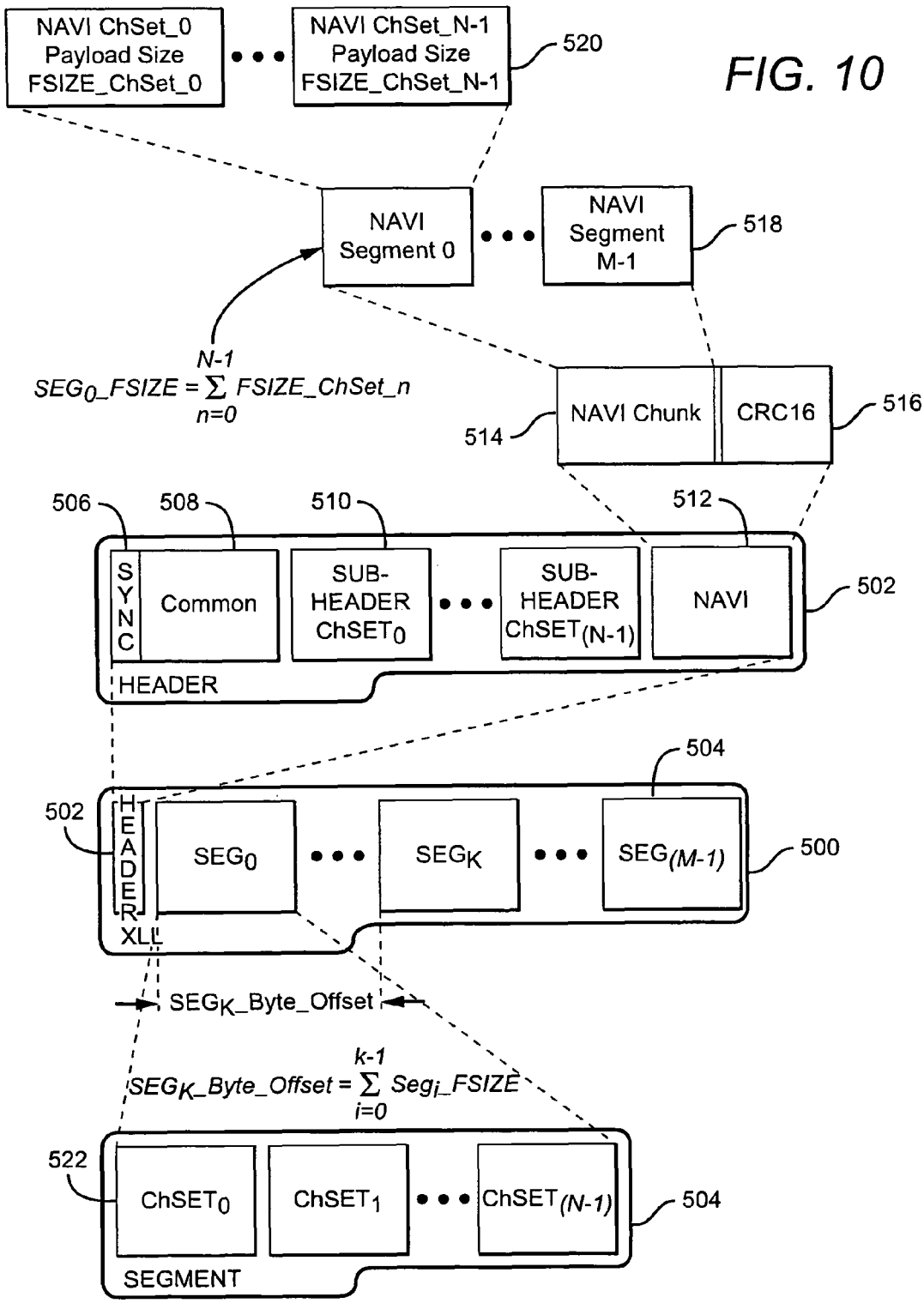
FIG. 10 is a diagram of a frame of a bit stream in which each frame includes a header and a plurality of segments.

As shown in FIG. 10, a frame 500 in bitstream 30 includes a header 502 and a plurality of segments 504. Header 502 includes a sync 506, a common header 508, a sub-header 510 for the one or more channel sets, and navigation data 512. In this embodiment, navigation data 512 includes a NAVI chunk 514 and error correction code CRC16 516. The NAVI chunk preferably breaks the navigation data down into the smallest portions of the bitstream to enable full navigation. The chunk includes NAVI segments 518 for each segment and each NAVI segment includes a NAVI Ch Set payload size 520 for each channel set. Among other things, this allows the decoder to navigate to the beginning of the RAP segment for any specified channel set. Each segment 504 includes the entropy coded residuals 522 (and original samples where prediction disabled for RAP) for each channel in each channel set.

The bitstream includes header information and encoded data for at least one and preferably multiple different channel sets. For example, a first channel set may be a 2.0 configuration, a second channel set may be an additional 4 channels constituting a 5.1 channel presentation, and a third channel set may be an additional 2 surround channels constituting overall 7.1 channel presentation. A 8-channel decoder would extract and decode all 3 channel sets producing a 7.1 channel presentation at its outputs. A 6-channel decoder will extract and decode channel set 1 and channel set 2 completely ignoring the channel set 3 producing the 5.1 channel presentation. A 2-channel decoder will only extract and decode channel set 1 and ignore channel sets 2 and 3 producing a 2-channel presentation. Having the stream structured in this manner allows for scalability of decoder complexity.

During the encode, a time encoder performs so called "embedded down-mixing" such that 7.1->5.1 down-mix is readily available in 5.1 channels that are encoded in channel sets 1 and 2. Similarly a 5.1->2.0 down-mix is readily available in 2.0 channels that are encoded as a channel set 1. A 6-channel decoder by decoding channel sets 1 and 2 will obtain 5.1 down-mix after undoing the operation of 5.1->2.0 down-mix embedding performed on the encode side. Similarly a full 8-channel decoder will obtain original 7.1 presentation by decoding channel sets 1, 2 and 3 and undoing the operation of 7.1->5.1 and 5.1->2.0 down-mix embedding performed on the encode side.

Figure 3:
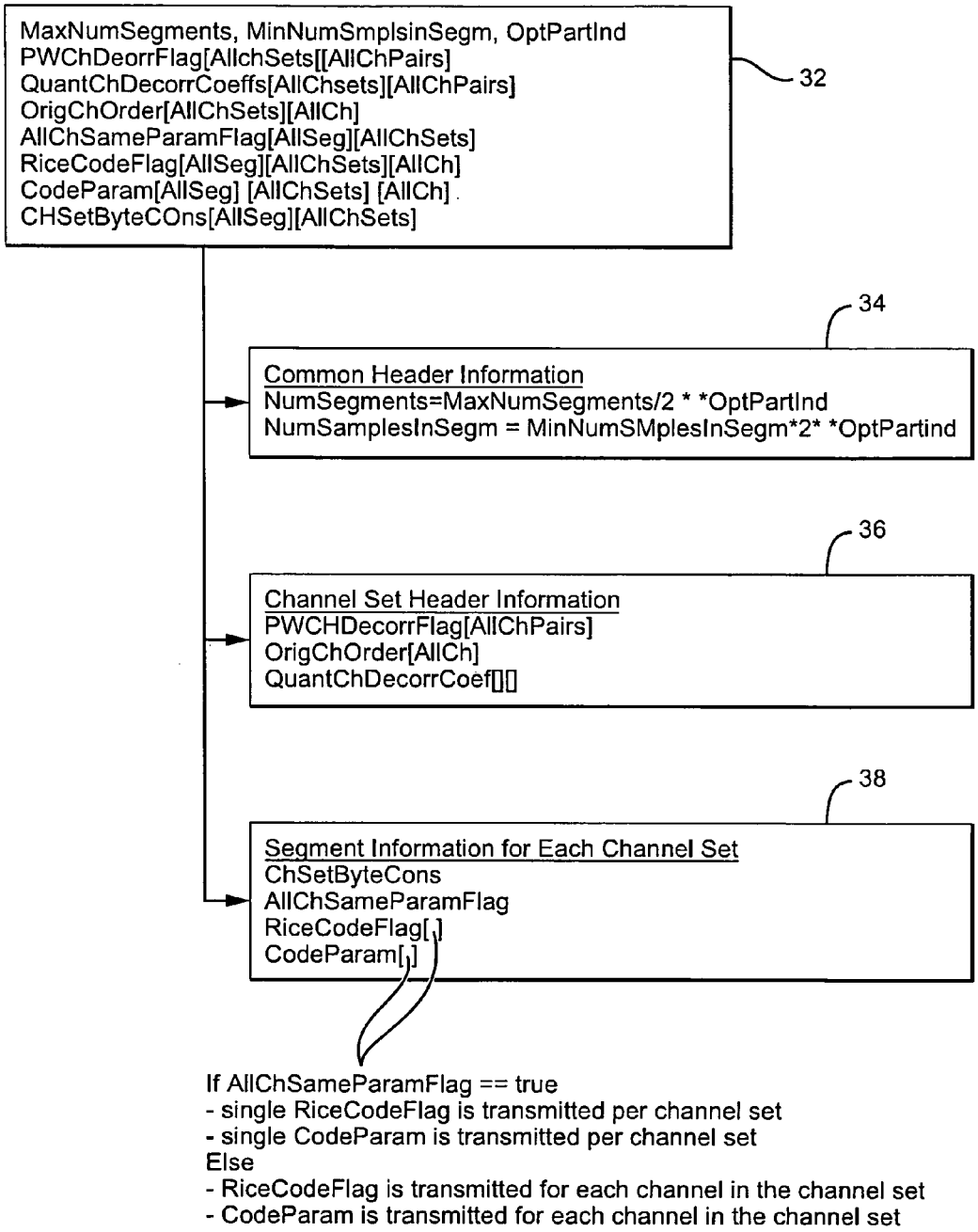
FIG. 3 is a diagram of header information as related to segmentation and entropy code selection.

As shown in FIG. 3, the header 32 includes additional information beyond what is ordinarily provided for a lossless codec in order to implement the segmentation and entropy code selection. More specifically, the header includes common header information 34 such as the number of segments (NumSegments) and the number of samples in each segment (NumSamplesInSegm), channel set header information 36 such as the quantized decorrelation coefficients (QuantChDecorrCoeff[ ] [ ]) and segment header information 38 such as the number of bytes in current segment for the channel set (ChSetByteCOns), a global optimization flag (AllChSameParamFlag) and entropy coder flags (RiceCodeFlag[ ], CodeParam[ ]) that indicate whether Rice or Binary coding is used and the coding parameter. This particular header configuration assumes segments of equal duration within a frame and segments that are a power of two of the analysis block duration. Segmentation of the frame is uniform across channels within a channel set and across channel sets.

As shown in FIG. 11*a*, the header further includes RAP parameters 530 in the common header that specify the existence and location of a RAP within a given frame. In this embodiment, the header includes a RAP flag=TRUE if RAP is present. The RAP ID specifies the segment number of the RAP segment to initiate decoding when accessing the bitstream at the desired RAP. Alternately, a RAP_MASK could be used to indicate segments that are and not a RAP. The RAP will be consistent across all channel sets.

As shown in FIG. 11*b*, the header includes AdPredOrder[0][ch]=order of the Adaptive Predictor or FixedPredOrder[0][ch]=order of the Fixed Predictor for channel ch in either the entire frame or in case of transient a first partition of the frame prior to a transient. When adaptive prediction is selected (AdPredOrder[0][ch]>0) adaptive prediction coefficients are encoded and packed into AdPredCodes[0][ch][AdPredOrder[0][ch]].

In case of MPPS the header further includes transient parameters 532 in the channel set header information. In this embodiment, each channel set header includes an ExtraPredSetsPrsent[ch] flag=TRUE if transient is detected in channel ch, StartSegment[ch]=index indicating the transient start segment for channel ch, and AdPredOrder[1][ch]=order of the Adaptive Predictor or FixedPredOrder[1][ch]=order of the Fixed Predictor for channel ch applicable to second partition in the frame post and including a transient. When adaptive prediction is selected (AdPredOrder[1][ch]>0) a second set of adaptive prediction coefficients are encoded and packed into AdPredCodes[1] [ch] [AdPredOrder[1] [ch]]. The existence and location of a transient may vary across the channels within a channel set and across channel sets.

Analysis Windows Processing

Figure 4A:
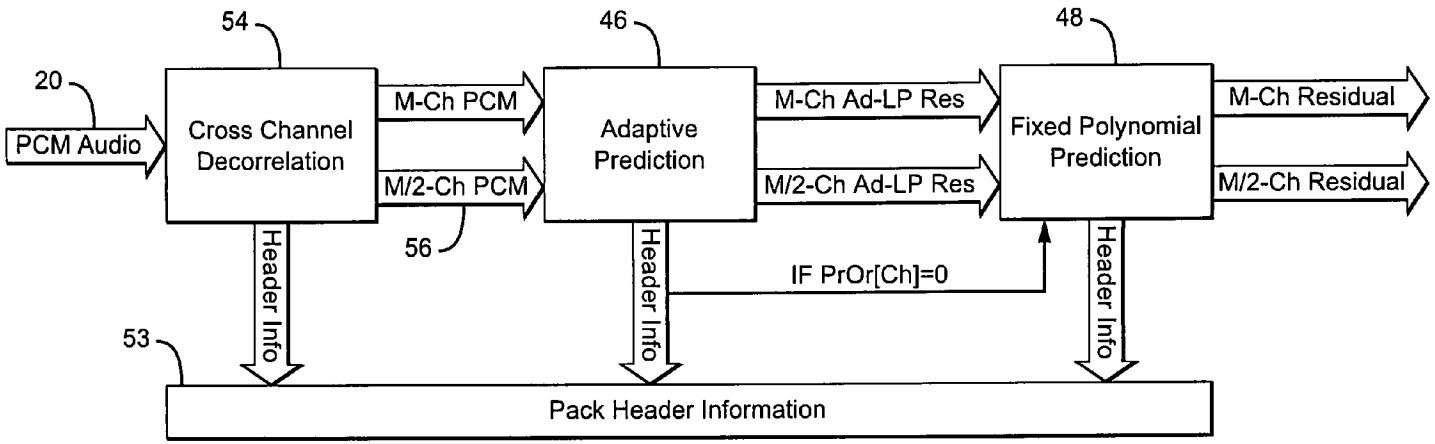
FIGS. 4*a* and 4*b* are block diagrams of the analysis window processing and inverse analysis window processing.
Figure 4B:
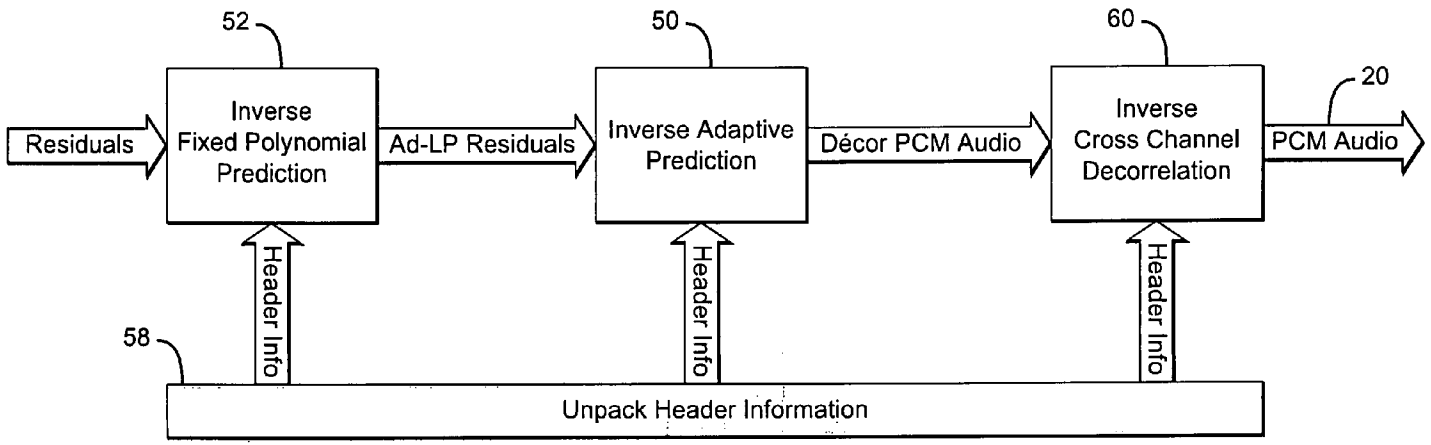

As shown in FIGS. 4*a* and 4*b*, an exemplary embodiment of analysis windows processing 22 selects from either adaptive prediction 46 or fixed polynomial prediction 48 to decorrelate each channel, which is a fairly common approach. As will be described in detail with reference to FIG. 6*a*, an optimal predictor order is estimated for each channel. If the order is greater than zero, adaptive prediction is applied. Otherwise the simpler fixed polynomial prediction is used. Similarly, in the decoder the inverse analysis windows processing 44 selects from either inverse adaptive prediction 50 or inverse fixed polynomial prediction 52 to reconstruct PCM audio from the residual signals. The adaptive predictor orders and adaptive prediction coefficient indices and fixed predictor orders are packed 53 in the channel set header information.

Cross-Channel Decorrelation

In accordance with the present invention, compression performance may be further enhanced by implementing cross channel decorrelation 54, which orders the M input channels into channel pairs according to a correlation measure between the channels (a different "M" than the M analysis block constraint on a desired RAP point). One of the channels is designated as the "basis" channel and the other is designated as the "correlated" channel. A decorrelated channel is generated for each channel pair to form a "triplet" (basis, correlated, decorrelated). The formation of the triplet provides two possible pair combinations (basis, correlated) and (basis, decorrelated) that can be considered during the segmentation and entropy coding optimization to further improve compression performance (see FIG. 8*a*).

The decision between (basis, correlated) and (basis, decorrelated) can be performed either prior to (based on some energy measure) or integrated with adaptive segmentation. The former approach reduces complexity while the latter increases efficiency. A 'hybrid' approach may be used where for triplets that have a decorrelated channel with considerably (based on a threshold) smaller variance then the correlated channel a simple replacement of the correlated channel by the decorrelated channel prior to adaptive segmentation is used while for all other triplets the decision about encoding correlated or decorrelated channel is left to the adaptive segmentation process. This simplifies the complexity of the adaptive segmentation process somewhat without sacrificing coding efficiency.

The original M-ch PCM 20 and the M/2-ch decorrelated PCM 56 are both forwarded to the adaptive prediction and fixed polynomial prediction operations, which generate residual signals for each of the channels. As shown in FIG. 3, indices (OrigChOrder[ ]) that indicate the original order of the channels prior to the sorting performed during the pairwise decorrelation process and a flag PWChDecorrFlag[ ] for each channel pair indicating the presence of a code for quantized decorrelation coefficients are stored in the channel set header 36 in FIG. 3.

As shown in FIG. 4*b*, to perform the decode operation of inverse analysis window processing 44 the header information is unpacked 58 and the residuals (original samples at start of RAP segment) are passed through either inverse fixed polynomial prediction 52 or inverse adaptive prediction 50 according to the header information, namely the adaptive and fixed predictor orders for each channel. In the presence of a transient in a channel, the channel set will have two different sets of prediction parameters for that channel. The M-channel decorrelated PCM audio (M/2 channels are discarded during segmentation) is passed through inverse cross channel decorrelation 60, which reads the OrigChOrder[ ] indices and PWChDecorrFlagg[ ] flag from the channel set header and losslessly reconstructs the M-channel PCM audio 20.

Figure 5:
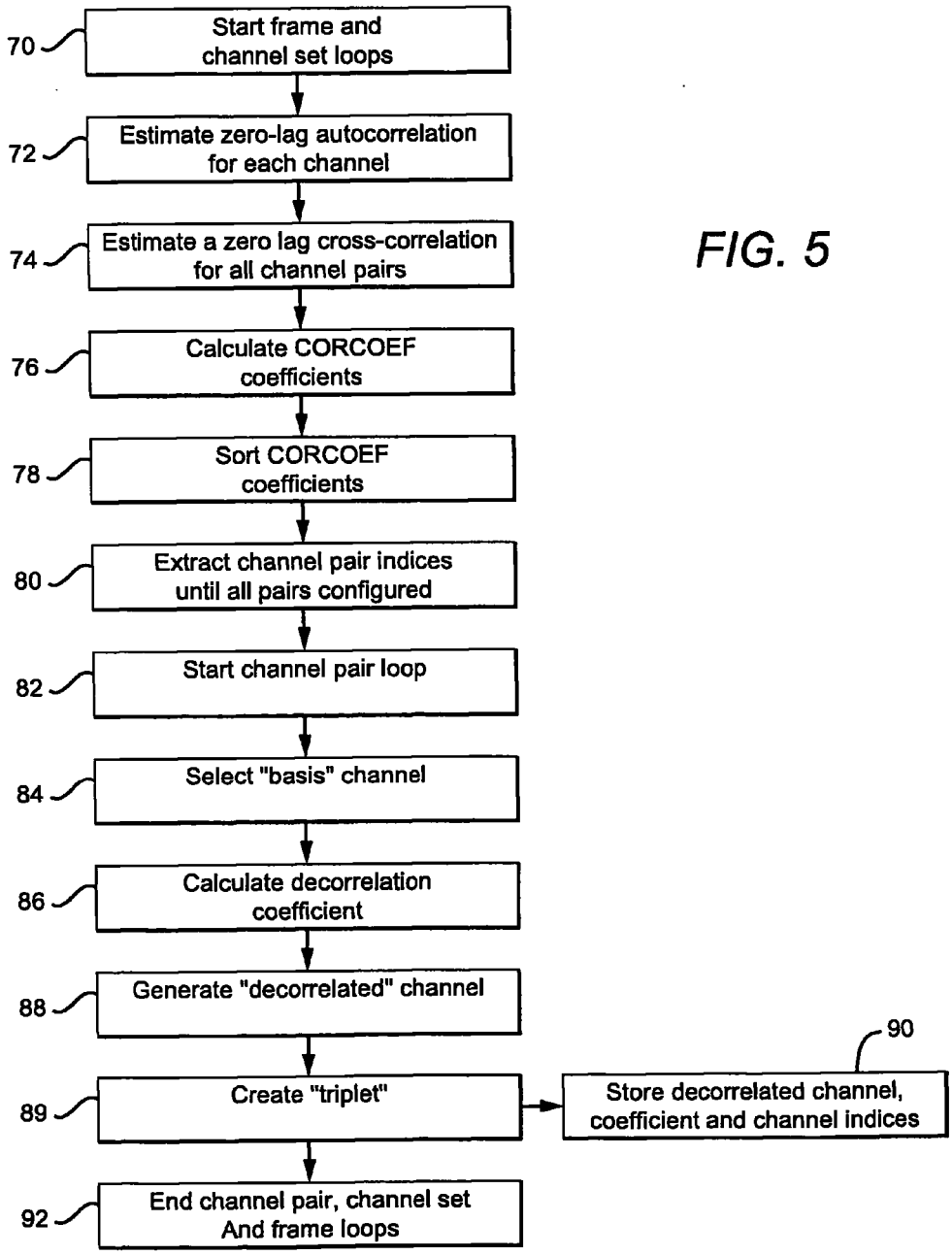
FIG. 5 is a flow chart of cross channel decorrelation.

An exemplary process for performing cross channel decorrelation 54 is illustrated in FIG. 5. By way of example, the PCM audio is provided as M=6 distinct channels, L, R, C, Ls, Rs and LFE, which also directly corresponds to one channel set configuration stored in the frame. Other channels sets may be, for example, left of center back surround and right of center back surround to produce 7.1 surround audio. The process starts by starting a frame loop and starting a channel set loop (step 70). The zero-lag auto-correlation estimate for each channel (step 72) and the zero-lag cross-correlation estimate for all possible combinations of channels pairs in the channel set (step 74) are calculated. Next, channel pair-wise correlation coefficients CORCOEF are estimated as the zero-lag cross-correlation estimate divided by the product of the zero-lag auto-correlation estimates for the involved channels in the pair (step 76). The CORCOEFs are sorted from the largest absolute value to the smallest and stored in a table (step 78). Starting from the top of the table, corresponding channel pair indices are extracted until all pairs have been configured (step 80). For example, the 6 channels may be paired based on their CORCOEF as (L,R), (Ls,Rs) and (C, LFE).

The process starts a channel pair loop (step 82), and selects a "basis" channel as the one with the smaller zero-lag auto-correlation estimate, which is indicative of a lower energy (step 84). In this example, the L, Ls and C channels form the basis channels. The channel pair decorrelation coefficient (ChPairDecorrCoeff) is calculated as the zero-lag cross-correlation estimate divided by the zero-lag auto-correlation estimate of the basis channel (step 86). The decorrelated channel is generated by multiplying the basis channel samples with the CHPairDecorrCoeff and subtracting that result from the corresponding samples of the correlated channel (step 88). The channel pairs and their associated decorrelated channel define "triplets" (L,R,R-ChPairDecorrCoeff[1] *L), (Ls,Rs,Rs-ChPairDecorrCoeff[2]*Ls), (C,LFE,LFE-ChPairDecorrCoeff[3]*C) (step 89). The ChPairDecorrCoeff [ ] for each channel pair (and each channel set) and the channel indices that define the pair configuration are stored in the channel set header information (step 90). This process repeats for each channel set in a frame and then for each frame in the windowed PCM audio (step 92).

Determine Segment Start Point for RAP and Transients

Figure 12:
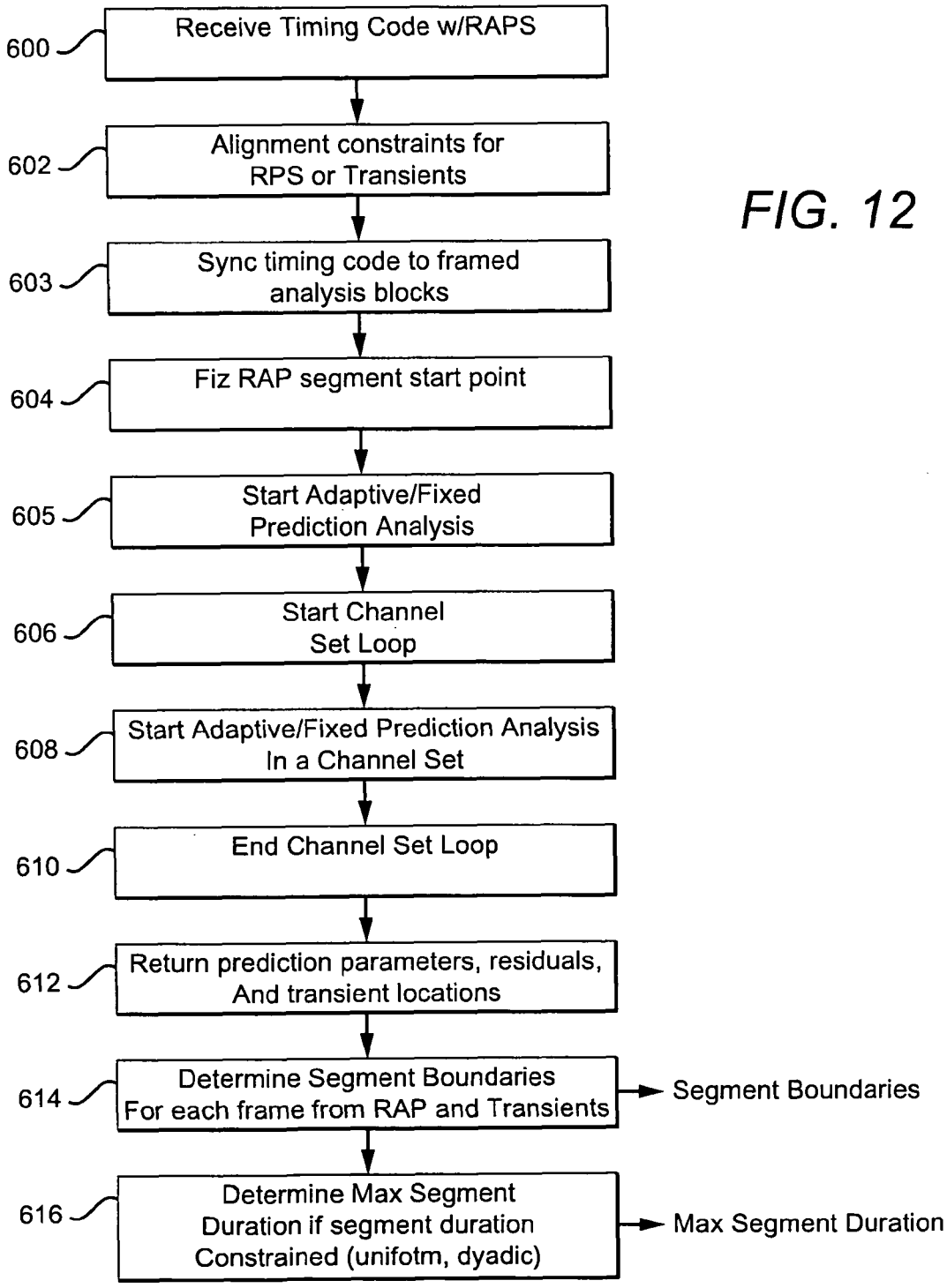
FIG. 12 is a flow chart for determining segment boundaries or a maximum segment duration for desired RAPs or detected transients.
Figure 13:
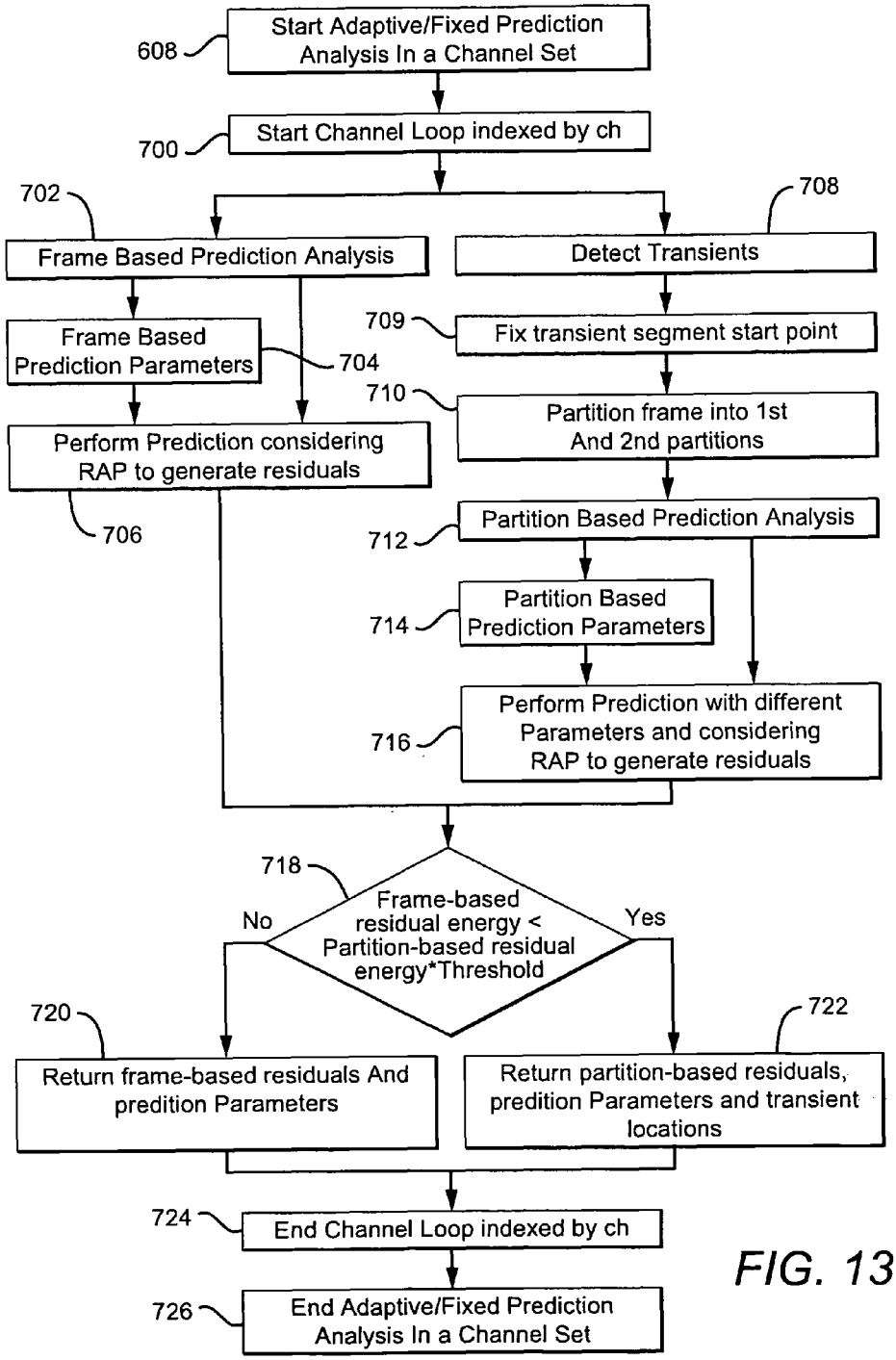
FIG. 13 is a flow chart for determining MPPSs.
Figure 14:
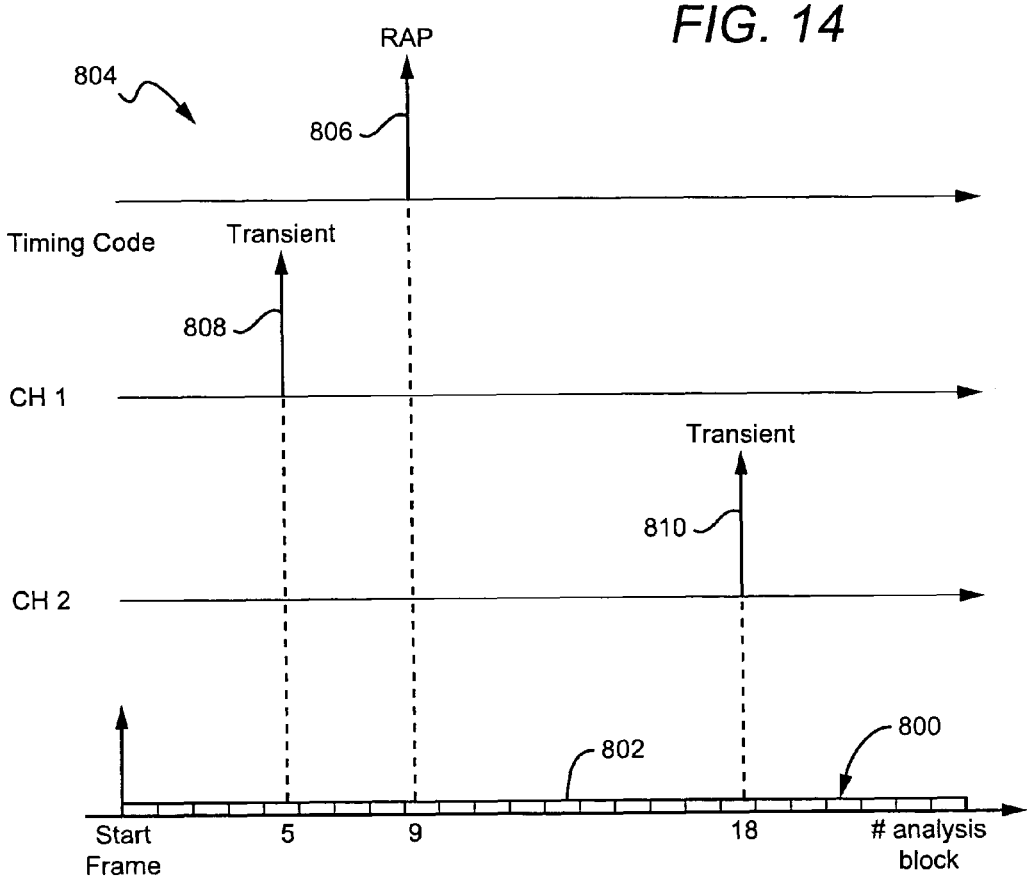
FIG. 14 is a diagram of a frame illustrating the selection of segment start points or a maximum segment duration.

An exemplary approach for determining segment start and duration constraints to accommodate desired RAPs and/or detected transients is illustrated in FIGS. 12 through 14. The minimum block of audio data that is processed is referred to as an "analysis block". Analysis blocks are only visible at the encoder, the decoder only processes segments. For example, an analysis block may represent 0.5 ms of audio data in a 32 ms frame including 64 analysis blocks. Segments are comprised of one or more analysis blocks. Ideally, the frame is partitioned so that a desired RAP or detected transient lies in the first analysis block of the RAP or transient segment. However, depending on the location of the desired RAP or transient to ensure this condition may force a sub-optimal segmentation (overly short segment durations) that increases encoded frame payload too much. Therefore, a tradeoff is to specify that any desired RAP must lie within M analysis blocks (different "M" than the M channels in channel decorrelation routine) of the start of the RAP segment and any transient must lie within the first L analysis blocks following the start of the transient segment in the corresponding channel. M and L are less than the total number of analysis blocks in the frame and chosen to ensure a desired alignment tolerance for each condition. For example, if a frame includes 64 analysis blocks, M and/or L could be 1, 2, 4, 8 or 16. Typically, some power of two less than the total and typically a small fraction thereof (no more than 25%) to provide true sub-frame resolution. Furthermore, although segment duration can be allowed to vary within a frame to do so greatly complicates the adaptive segmentation algorithm and increases header overhead bits with a relatively small improvement in coding efficiency. Consequently, a typical embodiment constrains the segments to be of equal duration within a frame and of a duration equal to a power of two of the analysis block duration, e.g. segment duration=$2^P$*analysis block duration where P=0, 1, 2, 4, 8 etc. In the more general case, the algorithm specifies the start of the RAP or transient segments. In the constrained case, the algorithm specifies a maximum segment duration for each frame that ensures the conditions are met.

As shown in FIG. 12, an encode timing code including desired RAPs such as a video timing code that specifies chapter or scene beginnings is provided by the application layer (step 600). Alignment tolerances that dictate the max values of M and L above are provided (step 602). The frames are blocked into a plurality of analysis blocks and synchronized to the timing code to align desired RAPs to analysis blocks (step 603). If a desired RAP lies within the frame, the encoder fixes the start of a RAP segment where the RAP analysis block must lie within M analysis blocks before or after the start of the RAP segment (step 604). Note, the desired RAP may actually lie in the segment preceding the RAP segment within M analysis blocks of the start of the RAP segment. The approach starts the Adaptive/Fixed Prediction analysis (step 605), starts the Channel Set Loop (step 606) and starts the Adaptive/Fixed Prediction Analysis in the channel set (step 608) by calling the routine illustrated in FIG. 13. The Channel Set Loop ends (step 610) with the routine returning the one set of prediction parameters (AdPredOrder[0][ ], FixedPredOrder[0][ ] and AdPredCodes[0][ ][ ]) for the case when ExtraPredSetsPresent[ ]=FALSE or two sets of prediction parameters (AdPredOrder[0][ ], FixedPredOrder[0][ ], AdPredCodes[0] [ ][ ], AdPredOrder[1] [ ], FixedPredOrder [1][ ] and AdPredCodes[1][ ][ ]) for the case when ExtraPredSetsPresent[ ]=TRUE, the residuals and the location of any detected transients (StartSegment[ ]) per channel (step 612). Step 608 is repeated for each channel set that is encoded in the bitstream. Segment start points for each frame are determined from the RAP segment start point and/or detected transient segment start points and passed to the adaptive segmentation algorithm of FIGS. 16 and **7*a*-7*b* (step 614). If the segment durations are constrained to be uniform and a power of two of the analysis block length, a maximum segment duration is selected based on the fixed start points and passed to the adaptive segmentation algorithm (step 616**). The maximum segment duration constraint maintains the fixed start points plus adding a constraint on duration.

An exemplary embodiment of the Start Adaptive/Fixed Prediction Analysis in a Channel Set routine (step 608) is provided in FIG. 13. The routine starts channel loop indexed by ch (step 700), computes frame-based prediction coefficients and partition-based prediction coefficients (if a transient is detected) and selects the approach with the best coding efficiency per channel. It is possible that even if a transient is detected, the most efficient coding is to ignore the transient. The routine returns the prediction parameter sets, residuals and the location of any encoded transients.

More specifically, the routine performs a frame-based prediction analysis by calling the adaptive prediction routine diagrammed in FIG. **6*a* (step 702) to select a set of frame based prediction parameters (step 704). This single set of parameters is then used to perform prediction on the frame of audio samples considering the start of any RAP segment in the frame (step 706**). More specifically, prediction is disabled at the start of the RAP segment for the first samples up to the order of the prediction. A measure of the frame-based residual norm e.g. the residual energy is estimated from the residual values and the original samples where prediction is disabled.

In parallel, the routine detects whether any transients exist in the original signal for each channel within the current frame (step 708). A threshold is used to balance between false detection and missed detection. The indices of the analysis block containing a transient are recorded. If a transient is detected, the routine fixes the start point of a transient segment that is positioned to ensure that the transient lies within the first L analysis blocks of the segment (step 709) and partitions the frame into first and second partitions with the second partition coincident with the start of the transient segment (step 710). The routine then calls the adaptive prediction routine diagrammed in FIG. 6*a* (step 712) twice to select first and second sets of partition based prediction parameters for the first and second partitions (step 714). The two sets of parameters are then used to perform prediction on the first and second partitions of audio samples, respectively, also considering the start of any RAP segment in the frame (step 716). A measure of the partition-based residual norm (e.g. residual energy) is estimated from the residual values and the original samples where prediction is disabled.

The routine compares the frame-based residual norm to the partition-based residual norm multiplied by a threshold to account for the increased header information required for multiple partitions for each channel (step 716). If the frame-based residual energy is smaller, then the frame-based residuals and prediction parameters are returned (step 718) otherwise the partition-based residuals, two sets of predictions parameters and the indices of the recorded transients are returned for that channel (step 720). The Channel Loop indexed by channel (step 722) and Adaptive/Fixed Prediction Analysis in a channel set (step 724) iterate over the channels in a set and all of the channel sets before ending.

The determination of the segment start points or maximum segment duration for a single frame 800 is illustrated in FIG. 14. Assume frame 800 is 32 ms and contains 64 analysis blocks 802 each 0.5 ms in duration. A video timing code 804 specifies a desired RAP 806 that falls within the $9^{th}$ analysis block. Transients 808 and 810 are detected in CH 1 and 2 that fall within the $5^{th}$ and $18^{th}$ analysis blocks respectively. In the unconstrained case, the routine may specify segment start points at analysis blocks 5, 9 and 18 to ensure that the RAP and transients lie in the $1^{st}$ analysis block of their respective segments. The adaptive segmentation algorithm could further partition the frame to meet other constraints and minimize frame payload as long as these start points are maintained. The adaptive segmentation algorithm may alter the segment boundaries and still fulfill the condition that the desired RAP or transient fall within a specified number of analysis blocks in order to fulfill other constraints or better optimize the payload.

In the constrained case, the routine determines a maximum segment duration that, in this example, satisfies the conditions on each of the desire RAP and the two transients. Since the desired RAP 806 falls within the $9^{th}$ analysis block, the max segment duration that ensures the RAP would lie in the $1^{st}$ analysis block of the RAP segment is 8× (scaled by duration of the analysis block). Therefore, the allowable segment sizes (as a multiple of two of the analysis block) are 1, 2, 4 and 8. Similarly, since Ch 1 transient 808 falls within the $5^{th}$ analysis block the maximum segment duration is 4. Transient 810 in CH 2 is more problematic in that to ensure that it occurs in the first analysis block requires a segment duration equal to the analysis block (1×). However, if the transient can be positioned in the second analysis block than the max segment duration is 16×. Under these constraints, the routine may select a max segment duration of 4 thereby allowing the adaptive segmentation algorithm to select from 1×, 2× and 4× to minimize frame payload and satisfy the other constraints.

In an alternative embodiment, the first segment of every nth frame may by default be a RAP segment unless the timing code specifies a different RAP segment in that frame. The default RAP may be useful, for example, to allow a user to jump around or "surf" within the audio bitstream rather than being constrained to only those RAPs specified by the video timing code.

Adaptive Prediction

Adaptive Prediction Analysis and Residual Generation

Linear prediction tries to remove the correlation between the samples of an audio signal. The basic principle of linear prediction is to predict a value of sample s(n) using the previous samples s(n−1), s(n−2), . . . and to subtract the predicted value $\hat{s}(n)$ from the original sample s(n). The resulting residual signal $e(n)=s(n)+\hat{s}(n)$ ideally will be uncorrelated and consequently have a flat frequency spectrum. In addition, the residual signal will have a smaller variance then the original signal implying that fewer bits are necessary for its digital representation.

In an exemplary embodiment of the audio codec, a FIR predictor model is described by the following equation:

$$e(n) = s(n) + Q\left\{\sum_{k=1}^{M} a_k * s(n-k)\right\}$$

where Q{ } denotes the quantization operation, M denotes the predictor order and $a_k$ are quantized prediction coefficients. A particular quantization Q{ } is necessary for lossless compression since the original signal is reconstructed on the decode side, using various finite precision processor architectures. The definition of Q{ } is available to both coder and decoder and reconstruction of the original signal is simply obtained by:

$$s(n) = e(n) - Q\left\{\sum_{k=1}^{M} a_k * s(n-k)\right\}$$

where it is assumed that the same $a_k$ quantized prediction coefficients are available to both encoder and decoder. A new set of predictor parameters is transmitted per each analysis window (frame) allowing the predictor to adapt to the time varying audio signal structure. In the case of transient detection, two new sets of prediction parameters are transmitted for the frame for each channel in which a transient is detected; one to decode residuals prior to the transient and one to decode residuals including and subsequent to the transient.

The prediction coefficients are designed to minimize the mean-squared prediction residual. The quantization Q{ } makes the predictor a nonlinear predictor. However in the exemplary embodiment the quantization is done with 24-bit precision and it is reasonable to assume that the resulting non-linear effects can be ignored during predictor coefficient optimization. Ignoring the quantization Q{ }, the underlying optimization problem can be represented as a set of linear equations involving the lags of signal autocorrelation sequence and the unknown predictor coefficients. This set of linear equations can be efficiently solved using the Levinson-Durbin (LD) algorithm.

The resulting linear prediction coefficients (LPC) need to be quantized, such that they can be efficiently transmitted in an encoded stream. Unfortunately direct quantization of LPC is not the most efficient approach since the small quantization errors may cause large spectral errors. An alternative representation of LPCs is the reflection coefficient (RC) representation, which exhibits less sensitivity to the quantization errors. This representation can also be obtained from the LD algorithm. By definition of the LD algorithm the RCs are guaranteed to have magnitude ≦1 (ignoring numerical errors). When the absolute value of the RCs is close to 1 the sensitivity of linear prediction to the quantization errors present in quantized RCs becomes high. The solution is to perform non-uniform quantization of RCs with finer quantization steps around unity. This can be achieved in two steps:

1) transform RCs to a log-area ratio (LAR) representation by means of mapping function $$LAR = \log\frac{1+RC}{1-RC}$$

where log denotes natural base logarithm.

2) quantize uniformly the LARs

The RC->LAR transformation warps the amplitude scale of parameters such that the result of steps 1 and 2 is equivalent to non-uniform quantization with finer quantization steps around unity.

Figure 6A:
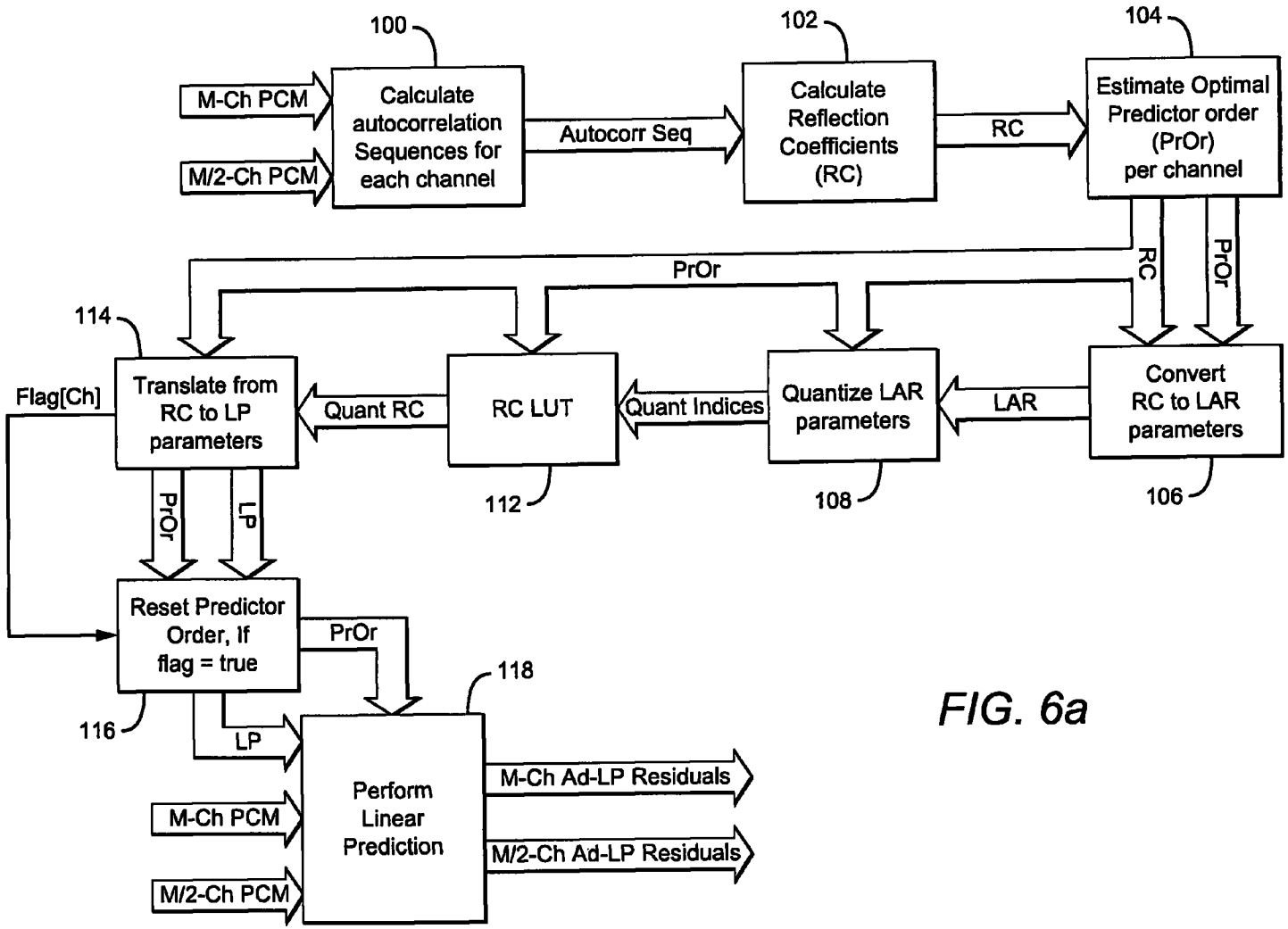
FIGS. 6*a* and 6*b* are block diagrams of adaptive prediction analysis and processing and inverse adaptive prediction processing.
Figure 6B:
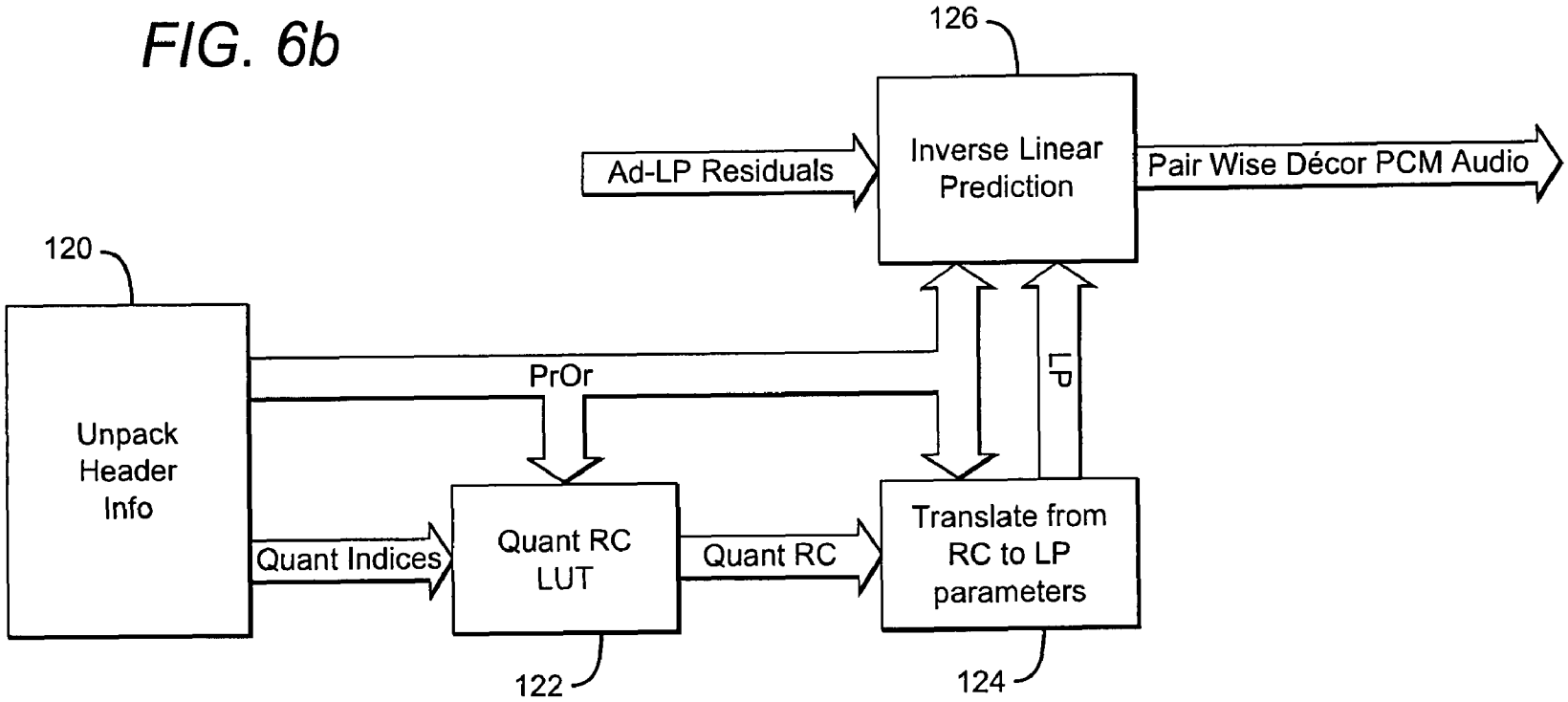
Figure 7A:
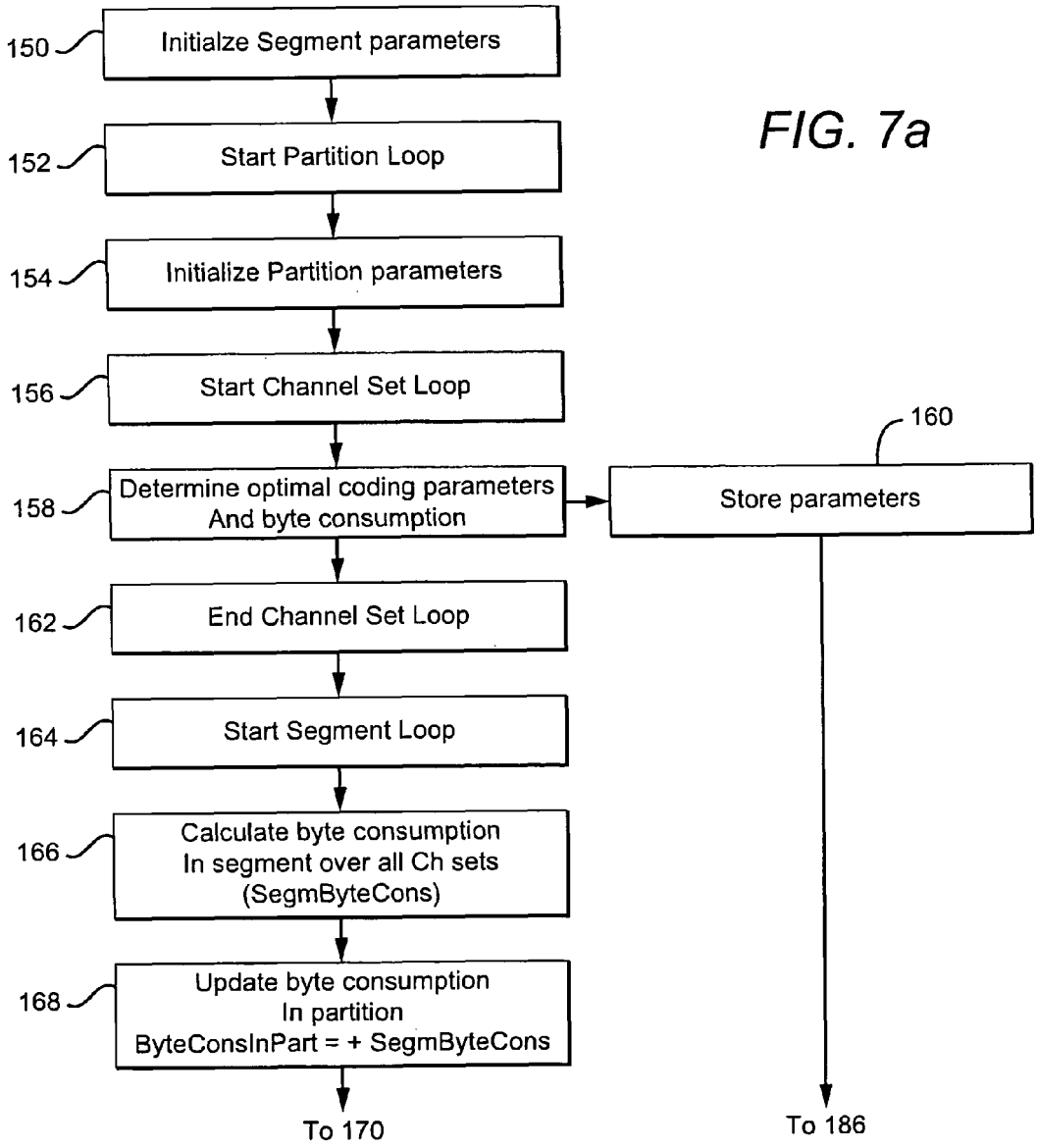
FIGS. 7*a* and 7*b* are a flow chart of optimal segmentation and entropy code selection.
Figure 7B:
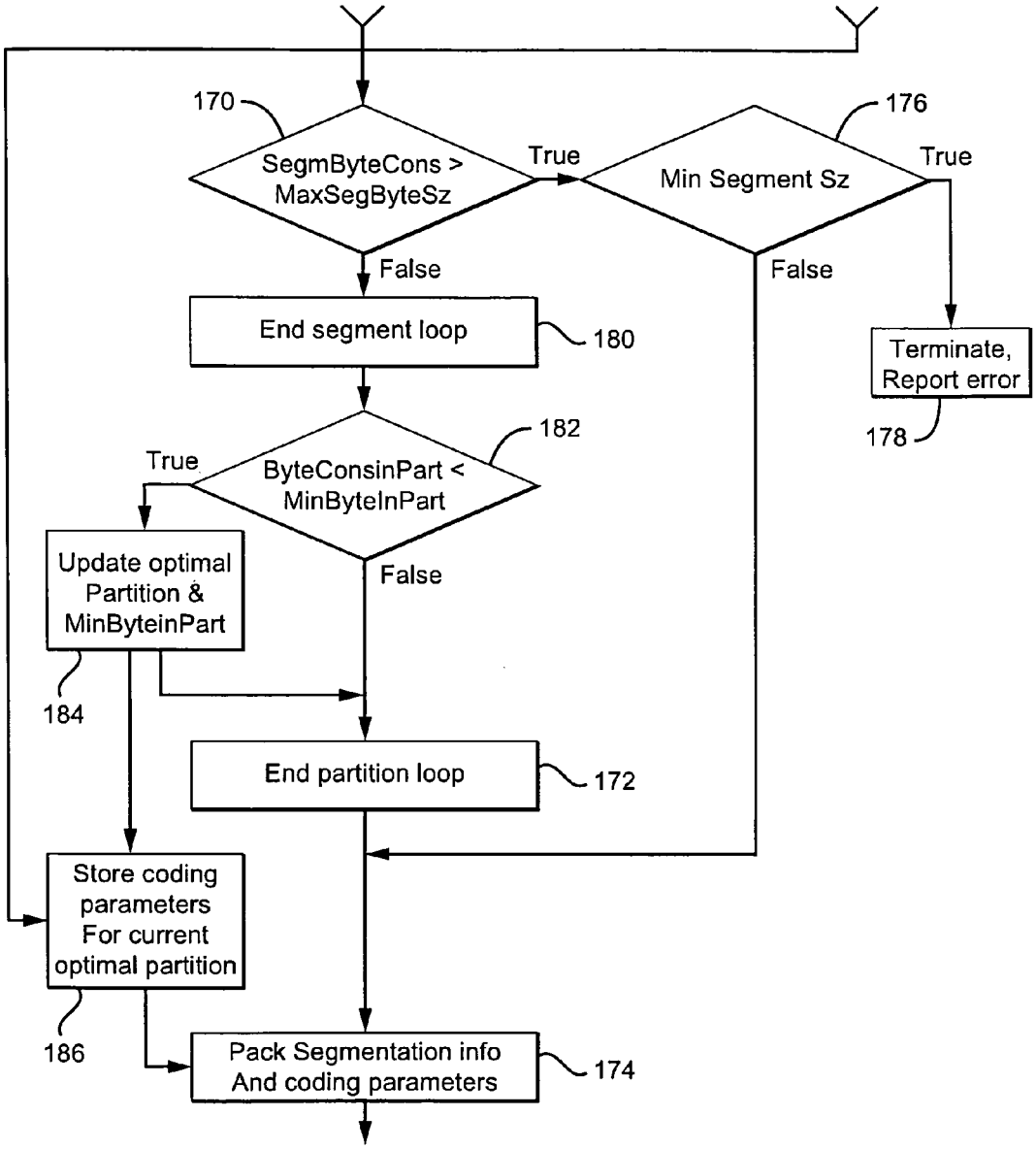

As shown in FIG. 6*a*, in an exemplary embodiment of adaptive prediction analysis quantized LAR parameters are used to represent adaptive predictor parameters and transmitted in the encoded bit-stream. Samples in each input channel are processed independent of each other and consequently the description will only consider processing in a single channel.

The first step is to calculate the autocorrelation sequence over the duration of analysis window (entire frame or partitions before and after a detected transient) (step 100). To minimize the blocking effects that are caused by discontinuities at the frame boundaries data is first windowed. The autocorrelation sequence for a specified number (equal to maximum LP order+1) of lags is estimated from the windowed block of data.

The Levinson-Durbin (LD) algorithm is applied to the set of estimated autocorrelation lags and the set of reflection coefficients (RC), up to the max LP order, is calculated (step 102). An intermediate result of the (LD) algorithm is a set of estimated variances of prediction residuals for each linear prediction order up to the max LP order. In the next block, using this set of residual variances, the linear predictor (AdPredOrder) order is selected (step 104).

For the selected predictor order the set of reflection coefficients (RC) is transformed to the set of log-area ratio parameters (LAR) using the above stated mapping function (step 106). A limiting of the RC is introduced prior to transformation in order to prevent division by 0:

$$RC = \begin{cases} Tresh & \forall\, RC > Tresh \\ -1 & \forall\, RC < 1 \\ RC & \text{Otherwise} \end{cases}$$

where Tresh denotes number close to but smaller then 1. The LAR parameters are quantized (step 108) according to the following rule:

$$QLARInd = \begin{cases} \left\lfloor \frac{LAR}{q} \right\rfloor & \forall\, LAR \geq 0 \\ -\left\lfloor \frac{-LAR}{q} \right\rfloor & \forall\, LAR < 0 \end{cases}$$

where QLARInd denotes the quantized LAR indices, ⌊x⌋ indicates operation of finding largest integer value smaller or equal to x and q denotes quantization step size. In the exemplary embodiment, region [−8 to 8] is coded using 8 bits i.e., $$q = \frac{2*8}{2^8}$$

and consequently QLARInd is limited according to:

$$QLARInd = \begin{cases} 127 & \forall\, QLARInd > 127 \\ -127 & \forall\, QLARInd < -127 \\ QLARInd & \text{Otherwise} \end{cases}$$

QLARInd are translated from signed to unsigned values using the following mapping:

$$AdPredCodes = \begin{cases} 2*QLARInd & \forall\, QLARInd \geq 0 \\ 2*(-QLARInd)-1 & \forall\, QLARIn < 0 \end{cases}$$

In the "RC LUT" block, an inverse quantization of LAR parameters and a translation to RC parameters is done in a single step using a look-up table (step 112). Look-up table consists of quantized values of the inverse RC->LAR mapping i.e., LAR->RC mapping given by:

$$RC = \frac{e^{LAR}-1}{e^{LAR}+1}$$

The look-up table is calculated at quantized values of LARs equal to 0, 1.5*q, 2.5*q, . . . 127.5*q. The corresponding RC values, after scaling by $2^{16}$, are rounded to 16 bit unsigned integers and stored as Q16 unsigned fixed point numbers in a 128 entry table.

Quantized RC parameters are calculated from the table and the quantization LAR indices QLARInd as $$QRC = \begin{cases} \text{TABLE}[QLARInd] & \forall\, QLARInd \geq 0 \\ -\text{TABLE}[-QLARInd] & \forall\, QLARInd < 0 \end{cases}$$

The quantized RC parameters $QRC_{ord}$ for ord=1, . . . AdPredOrder are translated to the quantized linear prediction parameters ($LP_{ord}$ for ord=1, . . . AdPredOrder) according to the following algorithm (step 114):

```
For ord = 0 to AdPredOrder − 1 do
    For m = 1 to ord do
        C_{ord+1,m} = C_{ord,m} + (QRC_{ord+1} * C_{ord,ord+1−m} + (1 << 15)) >> 16
    end
    C_{ord+1,ord+1} = QRC_{ord+1}
```

-continued

```
end
For ord = 0 to AdPredOrder − 1 do
    LP_{ord+1} = C_{AdPredOrder,ord+1}
end
```

Since the quantized RC coefficients were represented in Q16 signed fixed point format the above algorithm will generate the LP coefficients also in Q16 signed fixed point format. The lossless decoder computation path is designed to support up to 24-bit intermediate results. Therefore it is necessary to perform a saturation check after each $C_{ord+1,\ m}$ is calculated. If the saturation occurs at any stage of the algorithm the saturation flag is set and the adaptive predictor order AdPredOrder, for a particular channel, is reset to 0 (step 116). For this particular channel with AdPredOrder=0 a fixed coefficient prediction will be performed instead of the adaptive prediction (See Fixed Coefficient Prediction). Note that the unsigned LAR quantization indices (PackLARInd[n] for n=1, . . . AdPredOrder[Ch]) are packed into the encoded stream only for the channels with AdPredOrder[Ch]>0.

Finally for each channel with AdPredOrder>0 the adaptive linear prediction is performed and the prediction residuals e(n) are calculated according to the following equations (step 118):

$$\overline{s(n)} = \left[\left\{\sum_{k=1}^{AdPredOrder} LP_k * s(n-k)\right\} + (1 << 15)\right] >> 16$$

$$\text{Limit } \overline{s(n)} \text{ to 24-bit range } (-2^{23} \text{ to } 2^{23}-1)$$

$$e(n) = s(n) + \overline{s(n)}$$

$$\text{Limit } e(n) \text{ to 24-bit range } (-2^{23} \text{ to } 2^{23}-1)$$

$$\text{for } n = AdPredOrder + 1, \ldots NumSamples$$

Since the design goal in the exemplary embodiment is that a specific RAP segment of certain frames are "random access points", the sample history is not carried over from the preceding segment to the RAP segment. Instead the prediction is engaged only at the AdPredOrder+1 sample in the RAP segment.

The adaptive prediction residuals e(n) are further entropy coded and packed into the encoded bit-stream.

Inverse Adaptive Prediction on the Decode Side

On the decode side, the first step in performing inverse adaptive prediction is to unpack the header information (step 120). If the decoder is attempting to initiate decoding according to a playback timing code (e.g. user selection of a chapter or surfing), the decoder accesses the audio bitstream near but prior to that point and searches the header of the next frame until it finds a RAP_Flag=TRUE indicating the existence of a RAP segment in the frame. The decoder then extracts the RAP segment number (RAP ID) and navigation data (NAVI) to navigate to the beginning of the RAP segment, disables prediction until index >pred_order and initiates lossless decoding. The decoder decodes the remaining segments in the frames and subsequent frames, disabling prediction each time a RAP segment is encountered. If a ExtraPredSetsPrsnt=TRUE is encountered in a frame for a channel, the decoder extracts the first and second sets of prediction parameters and the start segment for the second set.

The adaptive prediction orders AdPredOrder[Ch] for each channel Ch=1, . . . . NumCh are extracted. Next for the channels with AdPredOrder[Ch]>0, the unsigned version of LAR quantization indices (AdPredCodes[n] for n=1, . . . AdPredOrder[Ch]) is extracted. For each channel Ch with prediction order AdPredOrder[Ch]>0 the unsigned AdPredCodes[n] are mapped to the signed values QLARInd[n] using the following mapping:

$$QLARInd[n] = \begin{cases} AdPredCodes[n] >> 1 & \forall \text{ even numbered } AdPredCodes[n] \\ -(AdPredCodes[n] >> 1) - 1 & \forall \text{ odd numbered } AdPredCodes[n] \end{cases}$$

$$\text{for } n = 1, \ldots, AdPredOrder[Ch]$$

where the >> denotes an integer right shift operation.

An inverse quantization of LAR parameters and a translation to RC parameters is done in a single step using a Quant RC LUT (step 122). This is the same look-up table TABLE{ } as defined on the encode side. The quantized reflection coefficients for each channel Ch (QRC[n] for n=1, . . . AdPredOrder[Ch]) are calculated from the TABLE{ } and the quantization LAR indices QLARInd[n], as $$QRC[n] = \begin{cases} \text{TABLE}[QLARInd[n]] & \forall\ QLARInd[n] \geq 0 \\ -\text{TABLE}[-QLARInd[n]] & \forall\ QLARInd[n] < 0 \end{cases}$$

$$\text{for } n = 1, \ldots, PrOr[Ch]^{31}$$

For each channel Ch, the quantized RC parameters $QRC_{ord}$ for ord=1, . . . AdPredOrder[Ch] are translated to the quantized linear prediction parameters ($LP_{ord}$ for ord=1, . . . AdPredOrder[Ch]) according to the following algorithm (step 124):

```
For ord = 0 to AdPredOrder − 1 do
    For m = 1 to ord do
        C_{ord+1,m} = C_{ord,m} + (QRC_{ord+1} * C_{ord,ord+1−m} + (1 << 15)) >> 16
    end
    C_{ord+1,ord+1} = QRC_{ord+1}
end
For ord = 0 to AdPredOrder − 1 do
    LP_{ord+1} = C_{AdPredOrder,ord+1}
end
```

Any possibility of saturation of intermediate results is removed on the encode side. Therefore on the decode side there is no need to perform saturation check after calculation of each $C_{ord+1,\ m}$.

Finally for each channel with AdPredOrder[Ch]>0 an inverse adaptive linear prediction is performed (step 126). Assuming that prediction residuals e(n) are previously extracted and entropy decoded the reconstructed original signals s(n) are calculated according to the following equations:

$$\overline{s(n)} = \left[\left\{\sum_{k=1}^{AdPredOrder[Ch]} LP_k * s(n-k)\right\} + (1 << 15)\right] >> 16$$

$$\text{Limit } \overline{s(n)} \text{ to 24-bit range } (-2^{23} \text{ to } 2^{23}-1)$$

$$e(n) = s(n) - \overline{s(n)}$$

$$\text{for } n = AdPredOrder[Ch] + 1, \ldots NumSamples$$

Since the sample history is not kept at a RAP segment the inverse adaptive prediction shall start from the (AdPredOrder [Ch]+1) sample in the RAP segment.

Fixed Coefficient Prediction

A very simple fixed coefficient form of the linear predictor has been found to be useful. The fixed prediction coefficients are derived according to a very simple polynomial approximation method first proposed by Shorten (T. Robinson. SHORTEN: Simple lossless and near lossless waveform compression. Technical report 156. Cambridge University Engineering Department Trumpington Street, Cambridge CB2 1PZ, UK December 1994). In this case the prediction coefficients are those specified by fitting a p order polynomial to the last p data points. Expanding on four approximations:

$$\hat{s}_0[n]=0$$

$$\hat{s}_1[n]=s[n-1]$$

$$\hat{s}_2[n]=2s[n-1]-s[n-2]$$

$$\hat{s}_3[n]=3s[n-1]-2s[n-2]+s[n-3]$$

An interesting property of these polynomials approximations is that the resulting residual signal, $e_k[n]=s[n]-\hat{s}_k[n]$ can be efficiently implemented in the following recursive manner.

$$e_0[n]=s[n]$$

$$e_1[n]=e_0[n]-e_0[n-1]$$

$$e_2[n]=e_1[n]-e_1[n-1]$$

$$e_3[n]=e_2[n]-e_2[n-1]$$

$$\ldots$$

The fixed coefficient prediction analysis is applied on a per frame basis and does not rely on samples calculated in the previous frame ($e_k[-1]=0$). The residual set with the smallest sum magnitude over entire frame is defined as the best approximation. The optimal residual order is calculated for each channel separately and packed into the stream as Fixed Prediction Order (FPO[Ch]). The residuals $e_{FPO[Ch]}[n]$ in the current frame are further entropy coded and packed into the stream.

The reverse fixed coefficient prediction process, on the decode side, is defined by an order recursive formula for the calculation of k-th order residual at sampling instance n:

$$e_k[n]=e_{k+1}[n]+e_k[n-1]$$

where the desired original signal s[n] is given by $$s[n]=e_0[n]$$

and where for each k-th order residual $e_k[-1]=0$.

As an example recursions for the 3rd order fixed coefficient prediction are presented where the residuals $e_3[n]$ are coded, transmitted in the stream and unpacked on the decode side:

$$e_2[n]=e_3[n]+e_2[n-1]$$

$$e_1[n]=e_2[n]+e_1[n-1]$$

$$e_0[n]=e_1[n]+e_0[n-1]$$

$$s[n]=e_0[n]$$

The inverse linear prediction, adaptive or fixed, performed in step 126 is illustrated for a case where the m+1 segment is a RAP segment 900 in FIG. 15*a* and where the m+1 segment is a transient segment 902 in FIG. 15*b*. A 5-tap predictor 904 is used to reconstruct the lossless audio samples. In general, the predictor recombines the 5 previous losslessly reconstructed samples to generate a predicted value 906 that is added to the current residual 908 to losslessly reconstruct the current sample 910. In the RAP example, the 1st 5 samples in the compressed audio bitstream 912 are uncompressed audio samples. Consequently, the predictor can initiate lossless decoding at segment m+1 without any history from the previous sample. In other words, segment m+1 is a RAP of the bitstream. Note, if a transient was also detected in segment m+1 the prediction parameters for segment m+1 and the rest of the frame would differ from those used in segments 1 to m. In the transient example, all of the samples in segments m and m+1 are residuals, no RAP. Decoding has been initiated and the prediction history for the predictor is available. As shown, to losslessly reconstruct audio samples in segments m and m+1 different sets of prediction parameters are used. To generate the 1st lossless sample 1 in segment m+1, the predictor uses the parameters for segment m+1 using the last five losslessly reconstructed samples from segment m. Note, if segment m+1 was also a RAP segment, the first five samples of segment m+1 would be original samples, not residuals. In general, a given frame may contain neither a RAP or transient, in fact that is the more typical result. Alternately, a frame may include a RAP segment or a transient segment or even both. One segment may be both a RAP and transient segment.

Because the segment start conditions and max segment duration are set based on the allowable location of a desired RAP or detected transient within a segment, the selection of the optimal segment duration may generate a bitstream in which the desired RAP or detected transient actually lie within segments subsequent to the RAP or transient segments. This might happen if the bounds M and L are relatively large and the optimal segment duration is less than M and L. The desired RAP may actually lie in a segment preceding the RAP segment but still be within the specified tolerance. The conditions on alignment tolerance on the encode side are still maintained and the decoder does not know the difference. The decoder simply accesses the RAP and transient segments.

Segmentation and Entropy Code Selection

Figure 16:
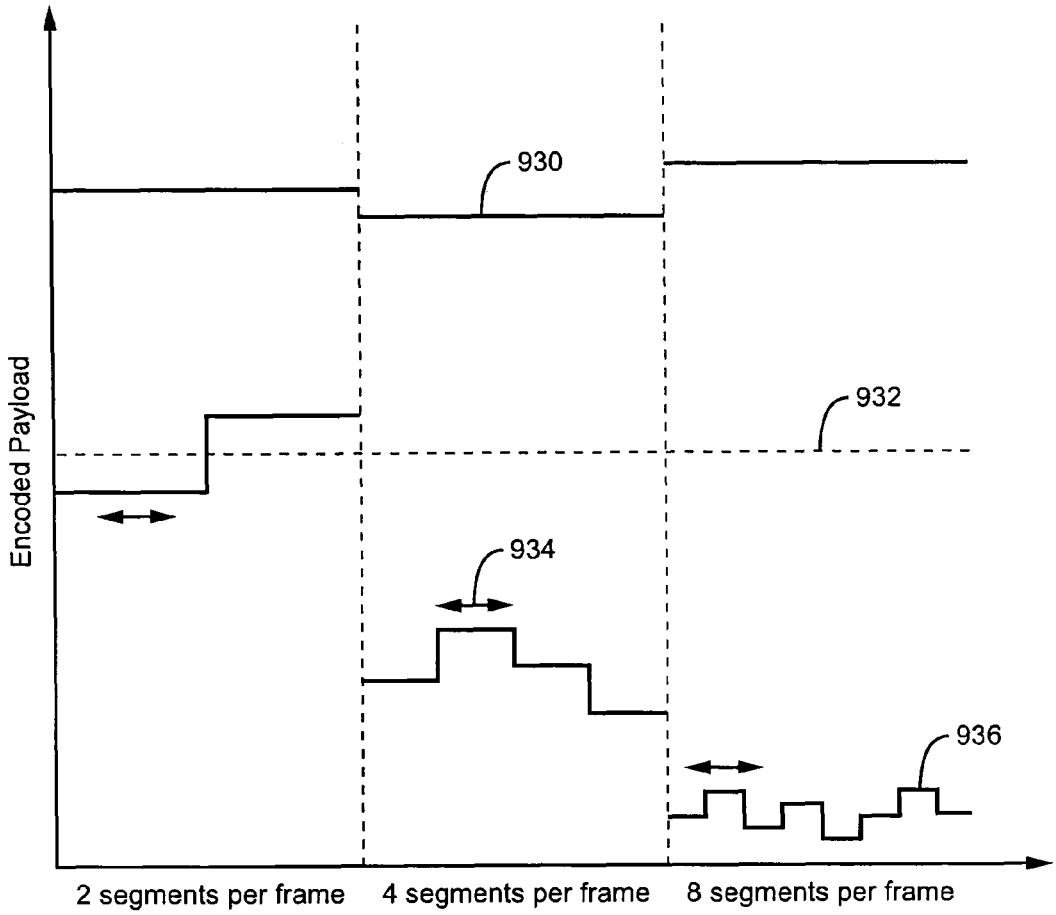
FIG. 16 is a diagram illustrating adaptive segmentation based on the maximum segment payload and maximum segment duration constraints.

The constrained optimization problem addressed by the adaptive segmentation algorithm is illustrated in FIG. 16. The problem is to encode one or more channel sets of multichannel audio in a VBR bitstream in such a manner to minimize the encoded frame payload subject to the constraints that each audio segment is fully and losslessly decodable with encoded segment payload less than a maximum number of bytes. The maximum number of bytes is less than the frame size and typically set by the maximum access unit size for reading the bitstream. The problem is further constrained to accommodate random access and transients by requiring that the segments be selected so that a desired RAP must lie plus or minus M analysis blocks of the start of the RAP segment and a transient must lie within the first L analysis blocks of a segment. The maximum segment duration may be further constrained by the size of the decoder output buffer. In this example, the segments within a frame are constrained to be of the same length and a power of two of the analysis block duration.

As shown in FIG. 16, the optimal segment duration to minimize encoded frame payload 930 balances improvements in prediction gain for a larger number of shorter duration segments against the cost of additional overhead bits. In this example, 4 segments per frame provides a smaller frame payload than either 2 or 8 segments. The two-segment solution is disqualified because the segment payload for the second segment exceeds the maximum segment payload constraint 932. The segment duration for both two and four segment partitions exceeds a maximum segment duration 934, which is set by some combination of, for example, the decoder output buffer size, location of a RAP segment start point and/or location of a transient segment start point. Consequently, the adaptive segmentation algorithm selects the 8 segments 936 of equal duration and the prediction and entropy coding parameters optimized for that partition.

An exemplary embodiment of segmentation and entropy code selection 24 for the constrained case (uniform segments, power of two of analysis block duration) is illustrated in FIGS. 7*a-b* and 8*a-b*. To establish the optimal segment duration, coding parameters (entropy code selection & parameters) and channel pairs, the coding parameters and channel pairs are determined for a plurality of different segment durations up to the maximum segment duration and from among those candidates the one with the minimum encoded payload per frame that satisfies the constraints that each segment must be fully and losslessly decodable and not exceed a maximum size (number of bytes) is selected. The "optimal" segmentation, coding parameters and channel pairs is of course subject to the constraints of the encoding process as well as the constraint on segment size. For example, in the exemplary process, the time duration of all segments in the frame is equal, the search for the optimal duration is performed on a dyadic grid starting with a segment duration equal to the analysis block duration and increasing by powers of two, and the channel pair selection is valid over the entire frame. At the cost of additional encoder complexity and overhead bits, the time duration can be allowed to vary within a frame, the search for the optimal duration could be more finely resolved and the channel pair selection could be done on a per segment basis. In this 'constrained' case, the constraint that ensures that any desired RAP or detected transient is aligned to the start of a segment within a specified resolution is embodied in the maximum segment duration.

The exemplary process starts by initializing segment parameters (step 150) such as the minimum number of samples in a segment, the maximum allowed encoded payload size of a segment, maximum number of segments and the maximum number of partitions and the maximum segment duration. Thereafter, the processing starts a partition loop that is indexed from 0 to the maximum number of partitions minus one (step 152) and initializes the partition parameters including the number of segments, num samples in a segment and the number of bytes consumed in a partition (step 154). In this particular embodiment, the segments are of equal time duration and the number of segments scales as a power of two with each partition iteration. The number of segments is preferably initialized to the maximum, hence minimum time duration, which is equal to one analysis block. However, the process could use segments of varying time duration, which might provide better compression of audio data but at the expense of additional overhead and additional complexity to satisfy the RAP and transient conditions. Furthermore, the number of segments does not have to be limited to powers of two or searched from the minimum to maximum duration. In this case, the segment start points determined by the desired RAP and detected transients are additional constraints on the adaptive segmentation algorithm.

Once initialized, the processes starts a channel set loop (step 156) and determines the optimal entropy coding parameters and channel pair selection for each segment and the corresponding byte consumption (step 158). The coding parameters PWChDecorrFlag[ ][ ], AllChSameParamFlag[ ][ ], RiceCodeFlag[ ][ ][ ], CodeParam[ ][ ][ ] and ChSetByteCons[ ][ ] are stored (step 160). This is repeated for each channel set until the channel set loop ends (step 162).

The process starts a segment loop (step 164) and calculates the byte consumption (SegmByteCons) in each segment over all channel sets (step 166) and updates the byte consumption (ByteConsInPart) (step 168). At this point, size of the segment (encoded segment payload in bytes) is compared to the maximum size constraint (step 170). If the constraint is violated the current partition is discarded. Furthermore, because the process starts with the smallest time duration, once a segment size is too big the partition loop terminates (step 172) and the best solution (time duration, channel pairs, coding parameters) to that point is packed into the header (step 174) and the process moves onto the next frame. If the constraint fails on the minimum segment size (step 176), then the process terminates and reports an error (step 178) because the maximum size constraint cannot be satisfied. Assuming the constraint is satisfied, this process is repeated for each segment in the current partition until the segment loop ends (step 180).

Once the segment loop has been completed and the byte consumption for the entire frame calculated as represented by ByteConsinPart, this payload is compared to the current minimum payload (MinByteInPart) from a previous partition iteration (step 182). If the current partition represents an improvement then the current partition (PartInd) is stored as the optimum partition (OptPartind) and the minimum payload is updated (step 184). These parameters and the stored coding parameters are then stored as the current optimum solution (step 186). This is repeated until the partition loop ends with the maximum segment duration (step 172), at which point the segmentation information and the coding parameters are packed into the header (step 174) as shown in FIGS. 3 and 11*a* and 11*b*.

Figure 8A:
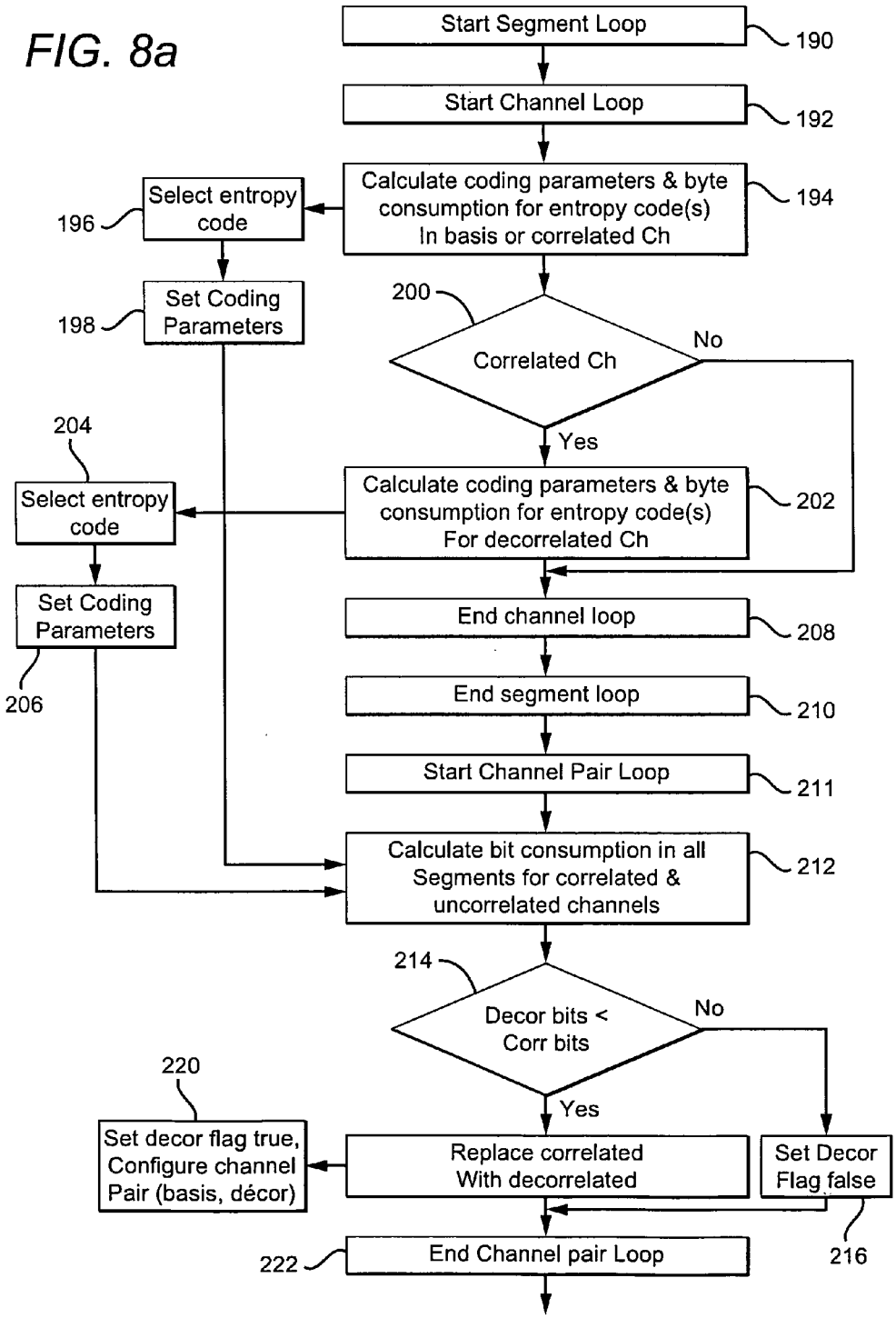
FIGS. 8*a* and 8*b* are flow charts of entropy code selection for a channel set.
Figure 8B:
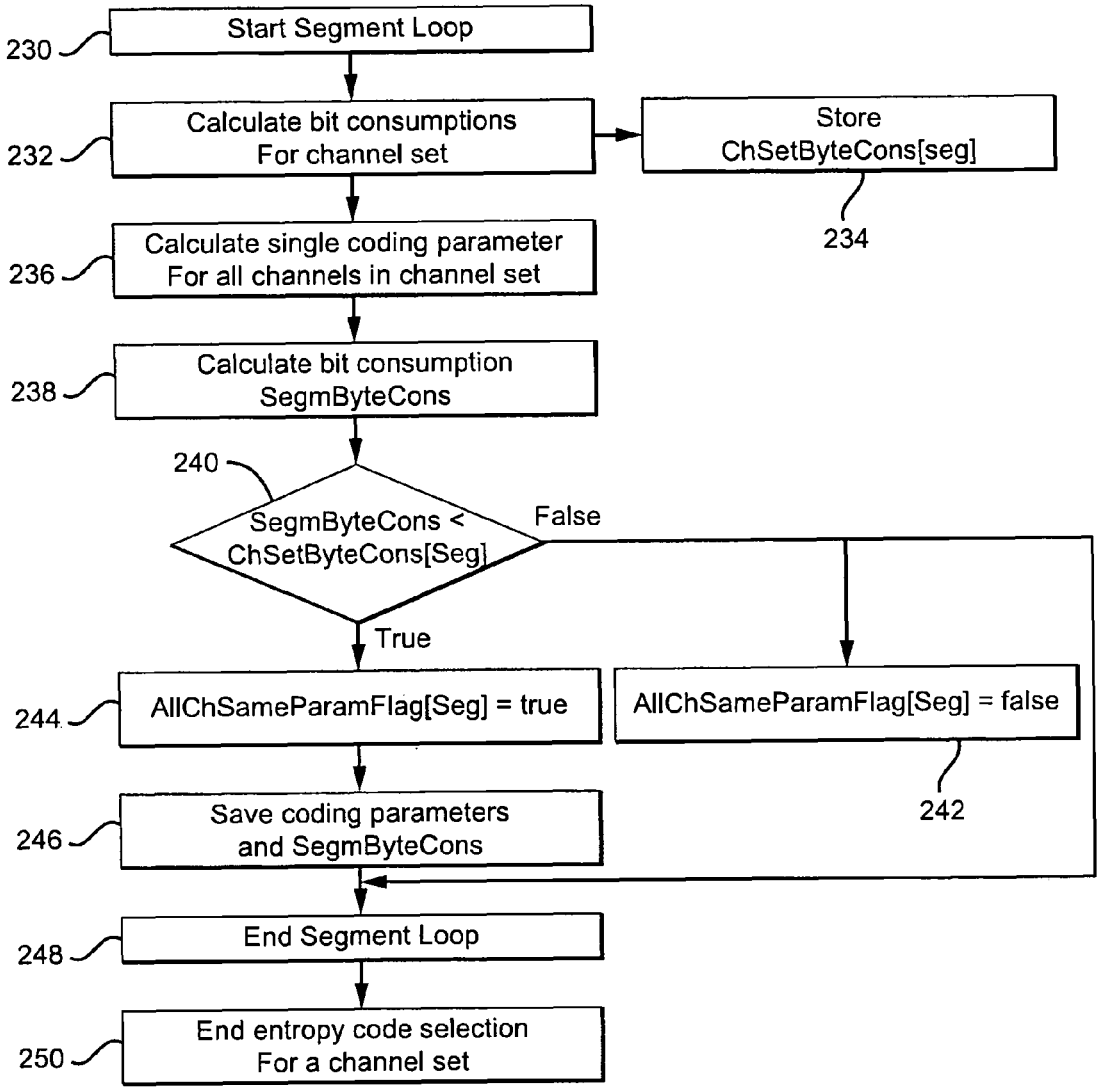

An exemplary embodiment for determining the optimal coding parameters and associated bit consumption for a channel set for a current partition (step 158) is illustrated in FIGS. 8*a* and 8*b*. The process starts a segment loop (step 190) and channel loop (step 192) in which the channels for our current example are:

Ch1: L,
Ch2: R
Ch3: R-ChPairDecorrCoeff[1]*L
Ch4: Ls
Ch5: Rs
Ch6: Rs-ChPairDecorrCoeff[2]*Ls
Ch7: C
Ch8: LFE
Ch9: LFE-ChPairDecorrCoeff[3]*C)

The process determines the type of entropy code, corresponding coding parameter and corresponding bit consumption for the basis and correlated channels (step 194). In this example, the process computes optimum coding parameters for a binary code and a Rice code and then selects the one with the lowest bit consumption for channel and each segment (step 196). In general, the optimization can be performed for one, two or more possible entropy codes. For the binary codes the number of bits is calculated from the max absolute value of all samples in the segment of the current channel. The Rice coding parameter is calculated from the average absolute value of all samples in the segment of the current channel. Based on the selection, the RiceCodeFlag is set, the BitCons is set and the CodeParam is set to either the NumBitsBinary or the RiceKParam (step 198).

If the current channel being processed is a correlated channel (step 200) then the same optimization is repeated for the corresponding decorrelated channel (step 202), the best entropy code is selected (step 204) and the coding parameters are set (step 206). The process repeats until the channel loop ends (step 208) and the segment loop ends (step 210).

At this point, the optimum coding parameters for each segment and for each channel have been determined. These coding parameters and payloads could be returned for the channel pairs (basis, correlated) from original PCM audio. However, compression performance can be improved by selecting between the (basis, correlated) and (basis, decorrelated) channels in the triplets.

To determine which channel pairs (basis, correlated) or (basis, uncorrelated) for the three triplets, a channel pair loop is started (step 211) and the contribution of each correlated channel (Ch2, Ch5 and Ch8) and each decorrelated channel (Ch3, Ch6 and Ch9) to the overall frame bit consumption is calculated (step 212). The frame consumption contributions for each correlated channel is compared against the frame consumption contributions for corresponding decorrelated channels, i.e., Ch2 to Ch3, Ch5 to Ch6, and Ch8 to Ch9 (step 214). If the contribution of the decorrelated channel is greater than the correlated channel, the PWChDecorrrFlag is set to false (step 216). Otherwise, the correlated channel is replaced with the decorrelated channel (step 218) and PWChDecorrrFlag is set to true and the channel pairs are configured as (basis, decorrelated) (step 220).

Based on these comparisons the algorithm will select:

1. Either Ch2 or Ch3 as the channel that will get paired with corresponding basis channel Ch1;
2. Either Ch5 or Ch6 as the channel that will get paired with corresponding basis channel Ch4; and
3. Either Ch8 or Ch9 as the channel that will get paired with corresponding basis channel Ch7.

These steps are repeated for all channel pairs until the loop ends (step 222).

At this point, the optimum coding parameters for each segment and each distinct channel and the optimal channel pairs have been determined. These coding parameters for each distinct, channel pairs and payloads could be returned to the partition loop. However, additional compression performance may be available by computing a set of global coding parameters for each segment across all channels. At best, the encoded data portion of the payload will be the same size as the coding parameters optimized for each channel and most likely somewhat larger. However, the reduction in overhead bits may more than offset the coding efficiency of the data.

Using the same channel pairs, the process starts a segment loop (step 230), calculates the bit consumptions (ChSetByteCons[seg]) per segment for all the channels using the distinct sets of coding parameters (step 232) and stores ChSetByteCons[seg] (step 234). A global set of coding parameters (entropy code selection and parameters) are then determined for the segment across all of the channels (step 236) using the same binary code and Rice code calculations as before except across all channels. The best parameters are selected and the byte consumption (SegmByteCons) is calculated (step 238). The SegmByteCons is compared to the CHSetByteCons[seg] (step 240). If using global parameters does not reduce bit consumption, the AllChSamParamFlag[seg] is set to false (step 242). Otherwise, the AllChSameParamFlag[seg] is set to true (step 244) and the global coding parameters and corresponding bit consumption per segment are saved (step 246). This process repeats until the end of the segment loop is reached (step 248). The entire process repeats until the channel set loop terminates (step 250).

The encoding process is structured in a way that different functionality can be disabled by the control of a few flags. For example one single flag controls whether the pairwise channel decorrelation analysis is to be performed or not. Another flag controls whether the adaptive prediction (yet another flag for fixed prediction) analysis is to be performed or not. In addition a single flag controls whether the search for global parameters over all channels is to be performed or not. Segmentation is also controllable by setting the number of partitions and minimum segment duration (in the simplest form it can be a single partition with predetermined segment duration). A flag indicates the existence of a RAP segment and another flag indicates the existence of a transient segment. In essence by setting a few flags in the encoder the encoder can collapse to simple framing and entropy coding.

Backward Compatible Lossless Audio Codec

The lossless codec can be used as an "extension coder" in combination with a lossy core coder. A "lossy" core code stream is packed as a core bitstream and a losslessly encoded difference signal is packed as a separate extension bitstream. Upon decoding in a decoder with extended lossless features, the lossy and lossless streams are combined to construct a lossless reconstructed signal. In a prior-generation decoder, the lossless stream is ignored, and the core "lossy" stream is decoded to provide a high-quality, multi-channel audio signal with the bandwidth and signal-to-noise ratio characteristic of the core stream.

FIG. 9 shows a system level view of a backward compatible lossless encoder 400 for one channel of a multi-channel signal. A digitized audio signal, suitably M-bit PCM audio samples, is provided at input 402. Preferably, the digitized audio signal has a sampling rate and bandwidth which exceeds that of a modified, lossy core encoder 404. In one embodiment, the sampling rate of the digitized audio signal is 96 kHz (corresponding to a bandwidth of 48 kHz for the sampled audio). It should also be understood that the input audio may be, and preferably is, a multi-channel signal wherein each channel is sampled at 96 kHz. The discussion which follows will concentrate on the processing of a single channel, but the extension to multiple channels is straightforward. The input signal is duplicated at node 406 and handled in parallel branches. In a first branch of the signal path, a modified lossy, wideband encoder 404 encodes the signal. The modified core encoder 404, which is described in detail below, produces an encoded core bitstream 408 which is conveyed to a packer or multiplexer 410. The core bitstream 408 is also communicated to a modified core decoder 412, which produces as output a modified, reconstructed core signal 414.

Meanwhile, the input digitized audio signal 402 in the parallel path undergoes a compensating delay 416, substantially equal to the delay introduced into the reconstructed audio stream (by modified encode and modified decoders), to produce a delayed digitized audio stream. The audio stream 400 is subtracted from the delayed digitized audio stream 414 at summing node 420.

Summing node 420 produces a difference signal 422 which represents the original signal and the reconstructed core signal. To accomplish purely "lossless" encoding, it is necessary to encode and transmit the difference signal with lossless encoding techniques. Accordingly, the difference signal 422 is encoded with a lossless encoder 424, and the extension bitstream 426 is packed with the core bitstream 408 in packer 410 to produce an output bitstream (not shown).

Note that the lossless coding produces an extension bitstream 426 which is at a variable bit rate, to accommodate the needs of the lossless coder. The packed stream is then optionally subjected to further layers of coding including channel coding, and then transmitted or recorded. Note that for purposes of this disclosure, recording may be considered as transmission through a channel.

The core encoder 404 is described as "modified" because in an embodiment capable of handling extended bandwidth the core encoder would require modification. A 64-band analysis filter bank 430 within the encoder discards half of its output data 432 and a core sub-band encoder 434 encodes only the lower 32 frequency bands. This discarded information is of no concern to legacy decoders that would be unable to reconstruct the upper half of the signal spectrum in any case. The remaining information is encoded as per the unmodified encoder to form a backwards-compatible core output stream. However, in another embodiment operating at or below 48 kHz sampling rate, the core encoder could be a substantially unmodified version of a prior core encoder. Similarly, for operation above the sampling rate of legacy decoders, the modified core decoder 412 includes a core sub-band decoder 436 that decodes samples in the lower 32 sub-bands. The modified core decoder takes the sub-band samples from the lower 32 sub-bands and zeros out the untransmitted sub-band samples for the upper 32 bands 438 and reconstructs all 64 bands using a 64-band QMF synthesis filter 440. For operation at conventional sampling rate (e.g., 48 kHz and below) the core decoder could be a substantially unmodified version of a prior core decoder or equivalent. In some embodiments the choice of sampling rate could be made at the time of encoding, and the encode and decode modules reconfigured at that time by software as desired.

Since the lossless encoder is being used to code the difference signal, it may seem that a simple entropy code would suffice. However, because of the bit rate limitations on the existing lossy core codecs, a considerable amount of the total bits required to provide a lossless bitstream still remain. Furthermore, because of the bandwidth limitations of the core codec the information content above 24 kHz in the difference signal is still correlated.

For example plenty of harmonic components including trumpet, guitar, triangle . . . reach far beyond 30 kHz. Therefore more sophisticated lossless codecs that improve compression performance add value. In addition, in some applications the core and extension bitstreams must still satisfy the constraint that the decodable units must not exceed a maximum size. The lossless codec of the present invention provides both improved compression performance and improved flexibility to satisfy these constrains.

By way of example, 8 channels of 24-bit 96 Khz PCM audio requires 18.5 Mbps. Lossless compression can reduce this to about 9 Mbps. DTS Coherent Acoustics would encode the core at 1.5 Mbps, leaving a difference signal of 7.5 Mbps. For 2 kByte max segment size, the average segment duration is 2048*8/7500000=2.18 msec or roughly 209 samples at 96 kHz. A typical frame size for the lossy core to satisfy the max size is between 10 and 20 msec.

At a system level, the lossless codec and the backward compatible lossless codec may be combined to losslessly encode extra audio channels at an extended bandwidth while maintaining backward compatibility with existing lossy codecs. For example, 8 channels of 96 kHz audio at 18.5 Mbps may be losslessly encoded to include 5.1 channels of 48 kHz audio at 1.5 Mbps. The core plus lossless encoder would be used to encode the 5.1 channels. The lossless encoder will be used to encode the difference signals in the 5.1 channels. The remaining 2 channels are coded in a separate channel set using the lossless encoder. Since all channel sets need to be considered when trying to optimize segment duration, all of the coding tools will be used in one way or another. A compatible decoder would decode all 8 channels and losslessly reconstruct the 96 kHz 18.5 Mbps audio signal. An older decoder would decode only the 5.1 channels and reconstruct the 48 kHz 1.5 Mbps.

In general, more then one pure lossless channel set can be provided for the purpose of scaling the complexity of the decoder. For example, for an 10.2 original mix the channel sets could be organized such that:

- CHSET1 carries 5.1 (with embedded 10.2 to 5.1 downmix) and is coded using core+lossless
- CHSET1 and CHSET2 carry 7.1 (with embedded 10.2 to 7.1 downmix) where CHSET2 encodes 2 channels using lossless
- CHSET1+CHSET2+CHSET3 carry full discrete 10.2 mix where CHSET3 encodes remaining 3.1 channels using lossless only A decoder that is capable of decoding just 5.1 will only decode CHSET1 and ignore all other channels sets. A decoder that is capable of decoding just 7.1 will decode CHSET1 and CHSET2 and ignore all other channels sets . . . .

Furthermore, the lossy plus lossless core is not limited to 5.1. Current implementations support up to 6.1 using lossy (core+XCh) and lossless and can support a generic m.n channels organized in any number of channel sets. The lossy encoding will have a 5.1 backward compatible core and all other channels that are coded with the lossy codec will go into the XXCh extension. This provides the overall lossless coded with considerable design flexibility to remain backward compatible with existing decoders while support additional channels.

While several illustrative embodiments of the invention have been shown and described, numerous variations and alternate embodiments will occur to those skilled in the art. Such variations and alternate embodiments are contemplated, and can be made without departing from the spirit and scope of the invention as defined in the appended claims.

I claim:

1. A method of encoding multi-channel audio with random access points (RAPs) into a lossless variable bit-rate (VBR) audio bitstream, comprising:

receiving an encode timing code that specifies desired random access points (RAPs) in the audio bitstream;

blocking the multi-channel audio including at least one channel set into frames of equal time duration, each frame including a header and a plurality of segments;

blocking each frame into a plurality of analysis blocks of equal duration, each said segment having a duration of one or more analysis blocks;

synchronizing the encode timing code to the sequence of frames to align desired RAPs to analysis blocks, the encode timing code being received and executed on a computing device;

for each successive frame, determining up to one RAP analysis block that is aligned with a desired RAP in the encode timing code;

fixing the start of a RAP segment whereby the RAP analysis block lies within M analysis blocks of the start;

determining at least one set of prediction parameters for the frame for each channel in the channel set;

compressing the audio frame for each channel in the channel set in accordance with the prediction parameters, said prediction being disabled for the first samples up to the prediction order following the start of the RAP segment to generate original audio samples preceded and/or followed by residual audio samples;

determining a segment duration and entropy coding parameters for each segment from the original and residual audio samples to reduce a variable sized encoded payload of the frame subject to constraints that each segment must be fully and losslessly decodable, have a duration less than the frame duration and have an encoded segment payload less than a maximum number of bytes less than the frame size;

packing header information including segment duration, RAP parameters indicating the existence and location of the RAP, prediction and entropy coding parameters and bitstream navigation data into the frame header in the bitstream; and packing the compressed and entropy coded audio data for each segment into the frame segments in the bitstream.

2. The method of claim 1, wherein the encode timing code is a video timing code specifying desired RAPs that correspond to the start of specific portions of a video signal.

3. The method of claim 1, wherein locating the RAP analysis block within M analysis blocks of the start of the RAP segment in the audio bitstream ensures decode capability within a specified alignment tolerance of the desired RAP.

4. The method of claim 1, wherein the first segment of every N frames is a default RAP segment unless a desired RAP lies within the frame.

5. The method of claim 1, further comprising:

detecting the existence of a transient in an analysis block in the frame for one or more channels of the channel set;

partitioning the frame so that any detected transients are located within the first L analysis blocks of a segment in their respective channels; and determining a first set or prediction parameters for segments prior to and not including a detected transient and a second set of prediction parameters for segments including and subsequent to the transient for each channel in the channel set; and determining the segment duration wherein a RAP analysis block must lie within M analysis blocks of the start of the RAP segment and a transient must lie within the first L analysis blocks of a segment in the corresponding channel.

6. The method of claim 5, further comprising:

using the location of the RAP analysis block and/or the location of a transient to determine a maximum segment duration as a power of two of the analysis block duration such that said RAP analysis block lies within M analysis blocks of the start of the RAP segment and the transient lies within the first L analysis blocks of a segment, wherein a uniform segment duration that is a power of two of the analysis block duration and does not exceed the maximum segment duration is determined to reduce encoded frame payload subject to the constraints.

7. The method of claim 1, further comprising:

using the location of the RAP analysis block to determine a maximum segment duration as a power of two of the analysis block duration such that said RAP analysis block lies within M analysis blocks of the start of the RAP segment, wherein a uniform segment duration that is a power of two of the analysis block duration and does not exceed the maximum segment duration is determined to reduce encoded frame payload subject to the constraints.

8. The method of claim 7, wherein the maximum segment duration is further constrained by the output buffer size available in a decoder.

9. The method of claim 1, wherein the maximum number of bytes for the encoded segment payload is imposed by an access unit size constraint of the audio bitstream.

10. The method of claim 1, wherein the RAP parameters include a RAP flag indicating the existence of a RAP and a RAP ID indicating the location of the RAP.

11. The method of claim 1 wherein a first channel set includes 5.1 multi-channel audio and a second channel set includes at least one additional audio channel.

12. The method of claim 1, further comprising generating a decorrelated channel for pairs of channels to form a triplet including a basis, correlated, and decorrelated channels, selecting either a first channel pair including a basis and a correlated channel or a second channel pair including a basis and a decorrelated channel, and entropy coding the channels in the selected channel pairs.

13. The method of claim 12, wherein the channel pairs are selected by:

If the variance of the decorrelated channel is smaller than the variance of the correlated channel by a threshold, select the second channel pair prior to determining segment duration; and Otherwise deferring selection of the first or second channel pair until determination of segment duration based on which channel pair contributes the fewest bits to the encoded payload.

14. One or more computer-readable media comprising computer-executable instructions that, when executed, perform the method as recited in claim 1.

15. One or more semiconductor devices comprising digital circuits configured to perform the method as recited in claim 1.

16. A method of initiated decoding of a lossless variable bit-rate (VBR) multi-channel audio bitstream at a random access point (RAP), comprising:

receiving a lossless VBR multi-channel audio bitstream as a sequence of frames partitioned into a plurality of segments having a variable length frame payload and including at least one independently decodable and losslessly reconstructable channel set including a plurality of audio channels for a multi-channel audio signal, each frame comprising header information including segment duration, RAP parameters that indicate the existence and location of up to one RAP segment, navigation data, channel set header information including prediction coefficients for each said channel in each said channel set, and segment header information for each said channel set including at least one entropy code flag and at least one entropy coding parameter, and entropy coded compressed multi-channel audio signals stored in said number of segments, wherein the lossless VBR multi-channel audio bitstream is received and executed on a computing device;

unpacking the header of the next frame in the bitstream to extract the RAP parameters until a frame having a RAP segment is detected;

unpacking the header of the selected frame to extract the segment duration and navigation data to navigate to the beginning of the RAP segment;

unpacking the header for the at least one said channel set to extract the entropy code flag and coding parameter and the entropy coded compressed multi-channel audio signals and perform an entropy decode on the RAP segment using the selected entropy code and coding parameter to generate compressed audio signals for the RAP segment; and unpacking the header for the at least one said channel set to extract prediction coefficients and reconstruct the compressed audio signals to losslessly reconstruct PCM audio for each audio channel in said channel set for the RAP segment; and decoding the remainder of the segments in the frame and subsequent frames in order.

17. The method of claim 16, wherein a desired RAP specified in the encode timing code lies within an alignment tolerance of the start of the RAP segment in the bitstream.

18. The method of claim 17, wherein the location of the RAP segment within a frame varies throughout the bitstream based on the location of the desired RAPs in the encoder timing code.

19. The method of claim 16, wherein the first audio samples of the RAP segment up to the prediction order are uncompressed, said prediction being disabled for the first audio samples up to the prediction order to losslessly reconstruct the PCM audio.

20. The method of claim 19, wherein after decoding has been initiated when another RAP segment is encountered in a subsequent frame the prediction is disabled for the first audio samples up to the prediction order to continue to losslessly reconstruct the PCM audio.

21. The method of claim 16, wherein the segment duration reduces the frame payload subject to the constraints that a desired RAP is aligned within a specified tolerance of the start of the RAP segment and each encoded segment payload be less than a maximum payload size less than the frame size and fully decodable and losslessly reconstructable once the segment is unpacked.

22. The method of claim 16, wherein the number and duration of segments varies frame-to-frame to minimize the variable length payload of each frame subject to constraints that the encoded segment payload be less than a maximum number of bytes, losslessly reconstructable and a desired RAP specified in an encode timing code lies within an alignment tolerance of the start of the RAP segment.

23. The method of claim 16, further comprising:

receiving each frame including header information including transient parameters that indicate the existence and location of a transient segment in each channel, prediction coefficients for each said channel including a single set of frame-based prediction coefficients if no transient is present and first and second sets of partition-based prediction coefficients if a transient is present in each said channel set, unpacking the header for the at least one said channel set to extract the transient parameters to determine the existence and location of transient segments in each channel in the channel set;

unpacking the header for the at least one said channel set to extract the single set of frame-based prediction coefficients or first and second sets of partition-based prediction coefficients for each channel depending on the existence of a transients; and for each channel in the channel set, applying either the single set of prediction coefficients to the compressed audio signals for all segments in the frame to losslessly reconstruct PCM audio or applying the first set of prediction coefficients to the compressed audio signals starting at the first segment and applying the second set of prediction coefficients to the compressed audio signals starting at the transient segment.

24. The method of claim 16, wherein the bitstream further comprises channel set header information including a pairwise channel decorrelation flag, an original channel order, and quantized channel decorrelation coefficients, said reconstruction generating decorrelated PCM audio, the method further comprising:

unpacking the header to extract the original channel order, the pairwise channel decorrelation flag and the quantized channel decorrelation coefficients and perform an inverse cross channel decorrelation to reconstruct PCM audio for each audio channel in said channel set.

25. The method of claim 24, wherein the pairwise channel decorrelation flag indicates whether a first channel pair including a basis and a correlated channel or a second channel pair including the basis and a decorrelated channel for a triplet including the basis, correlated and decorrelated channels was encoded, the method further comprising:

if the flag indicates a second channel pair, multiply the basis channel by the quantized channel decorrelation coefficient and add it to the decorrelated channel to generate PCM audio in the correlated channel.

26. One or more computer-readable media comprising computer-executable instructions that, when executed, perform the method as recited in claim 16.

27. One or more semiconductor devices comprising digital circuits configured to perform the method as recited in claim 16.

28. A method of encoding multi-channel audio into a lossless variable bit-rate (VBR) audio bitstream, comprising:

blocking the multi-channel audio including at least one channel set into frames of equal time duration, each frame including a header and a plurality of segments, each said segment having a duration of one or more analysis blocks, wherein the multi-channel audio is blocked and executed on a computing device;

for each successive frame, detecting the existence of a transient in a transient analysis block in the frame for each channel of the channel set;

partitioning the frame so that any transient analysis blocks are located within the first L analysis blocks of a segment in their corresponding channels;

determining a first set of prediction parameters for segments prior to and not including the transient analysis block and a second set of prediction parameters for segments including and subsequent to the transient analysis block for each channel in the channel set;

compressing the audio data using the first and second sets of prediction parameters on a first and a second partition, respectively, to generate residual audio signals;

determining a segment duration and entropy coding parameters for each segment from the residual audio samples to reduce a variable sized encoded payload of the frame subject to constraints that each segment must be fully and losslessly decodable, have a duration less than the frame duration and have an encoded segment payload less than a maximum number of bytes less than the frame size;

packing header information including segment duration, transient parameters indicating the existence and location of the transient, prediction parameters, entropy coding parameters and bitstream navigation data into the frame header in the bitstream; and packing the compressed and entropy coded audio data for each segment into the frame segments in the bitstream.

29. The method of claim 28, further comprising for each channel in the channel set:

determining a third set of prediction parameters for the entire frame;

compressing the audio data using the third set of prediction parameters on the entire frame to generate residual audio signals; and selecting either the third set or first and second sets of prediction parameters based on a measure of coding efficiency from their respective residual audio signals, wherein if said third set is selected disabling the constraint on segment duration regarding location of the transient within L analysis blocks of the start of a segment.

30. The method of claim 28, further comprising:

receiving a timing code that specifies desired random access points (RAPs) in the audio bitstream;

determining up to one RAP analysis block within the frame from the timing code;

fixing the start of a RAP segment so that the RAP analysis block lies within M analysis blocks of the start;

considering the segment boundary imposed by the RAP segment when partitioning the frame to determine the first and second sets of prediction parameters;

disabling said prediction for the first samples up to the prediction order following the start of the RAP segment to generate original audio samples preceded and/or followed by residual audio samples for said first and second, and third sets of prediction parameters;

determining the segment duration that reduces encoded frame payload while satisfying the constraints that a RAP analysis block lie with M analysis blocks of the start of the RAP segment and/or transient analysis blocks must lie within the first L analysis blocks of a segment; and packing RAP parameters indicating the existence and location of the RAP and bitstream navigation data into the frame header.

31. The method of claim 28, further comprising:

using the detected location of the transient analysis block to determine a maximum segment duration as a power of two of the analysis block duration such that said transient lies within the first L analysis blocks of a segment, wherein a uniform segment duration that is a power of two of the analysis block duration and does not exceed the maximum segment duration is determined to reduce encoded frame payload subject to the constraints.

32. The method of claim 31, wherein the maximum segment duration is further constrained by the output buffer size available in a decoder.

33. The method of claim 28, wherein the maximum number of bytes for the encoded segment payload is imposed by an access unit size constraint of the audio bitstream.

34. The method of claim 28, wherein said bitstream includes first and second channel sets, said method selecting first and second sets of prediction parameters for each channel in each channel set based on the detection of transients at different locations for at least one channel in the respective channel sets, wherein said segment duration is determined so that each said transient lies within the first L analysis blocks of a segment in which the transient occurs.

35. The method of claim 34, wherein the first channel set includes 5.1 multi-channel audio and the second channel set includes at least one additional audio channel.

36. The method of claim 28, wherein the transient parameters include a transient flag indicating the existence of a transient and a transient ID indicating the segment number in which the transient occurs.

37. The method of claim 28, further comprising generating a decorrelated channel for pairs of channels to form a triplet including a basis, correlated, and decorrelated channels, selecting either a first channel pair including a basis and a correlated channel or a second channel pair including a basis and a decorrelated channel, and entropy coding the channels in the selected channel pairs.

38. The method of claim 37, wherein the channel pairs are selected by:

If the variance of the decorrelated channel is smaller than the variance of the correlated channel by a threshold, select the second channel pair prior to determining segment duration; and Otherwise deferring selection of the first or second channel pair until determination of segment duration based on which channel pair contributes the fewest bits to the encoded payload.

39. One or more computer-readable media comprising computer-executable instructions that, when executed, perform the method as recited in claim 28.

40. One or more semiconductor devices comprising digital circuits configured to perform the method as recited in claim 28.

41. A method of decoding a lossless variable bit-rate (VBR) multi-channel audio bitstream, comprising:

receiving a lossless VBR multi-channel audio bitstream as a sequence of frames partitioned into a plurality of segments having a variable length frame payload and including at least one independently decodable and losslessly reconstructable channel set including a plurality of audio channels for a multi-channel audio signal, each frame comprising header information including segment duration, channel set header information including transient parameters that indicate the existence and location of a transient segment in each channel, prediction coefficients for each said channel including a single set of frame-based prediction coefficients if no transient is present and first and second sets of partition-based prediction coefficients if a transient is present in each said channel set, and segment header information for each said channel set including at least one entropy code flag and at least one entropy coding parameter, and entropy coded compressed multi-channel audio signals stored in said number of segments wherein the lossless VBR multi-channel audio bitstream is received and executed on a computing device;

unpacking the header to extract the segment duration;

unpacking the header for the at least one said channel set to extract the entropy code flag and coding parameter and the entropy coded compressed multi-channel audio signals for each segment and perform an entropy decode on each segment using the selected entropy code and coding parameter to generate compressed audio signals for each segment;

unpacking the header for the at least one said channel set to extract the transient parameters to determine the existence and location of transient segments in each channel in the channel set;

unpacking the header for the at least one said channel set to extract the single set of frame-based prediction coefficients or first and second sets of partition-based prediction coefficients for each channel depending on the existence of a transients; and for each channel in the channel set, applying either the single set of prediction coefficients to the compressed audio signals for all segments in the frame to losslessly reconstruct PCM audio or applying the first set of prediction coefficients to the compressed audio signals starting at the first segment and applying the second set of prediction coefficients to the compressed audio signals starting at the transient segment.

42. The method of claim 41, wherein the bitstream further comprises channel set header information including a pairwise channel decorrelation flag, an original channel order, and quantized channel decorrelation coefficients, said reconstruction generating decorrelated PCM audio, the method further comprising:

unpacking the header to extract the original channel order, the pairwise channel decorrelation flag and the quantized channel decorrelation coefficients and perform an inverse cross channel decorrelation to reconstruct PCM audio for each audio channel in said channel set.

43. The method of claim 42, wherein the pairwise channel decorrelation flag indicates whether a first channel pair including a basis and a correlated channel or a second channel pair including the basis and a decorrelated channel for a triplet including the basis, correlated and decorrelated channels was encoded, the method further comprising:

if the flag indicates a second channel pair, multiply the basis channel by the quantized channel decorrelation coefficient and add it to the decorrelated channel to generate PCM audio in the correlated channel.

44. The method of claim 41, further comprising:

receiving a frame having header information including RAP parameters that indicate the existence and location of up to one RAP segment and navigation data;

unpacking the header of the next frame in the bitstream to extract the RAP parameters, if trying to initiate decoding at RAP skipping to the next frame until a frame having a RAP segment is detected and using the navigation data to navigate to the beginning of the RAP segment; and when a RAP segment is encountered, disabling prediction for the first audio samples up to the prediction order to losslessly reconstruct the PCM audio.

45. The method of claim 41, wherein the number and duration of segments varies frame-to-frame to minimize the variable length payload of each frame subject to constraints that the encoded segment payload be less than a maximum number of bytes less than the frame size and losslessly reconstructable.

46. One or more computer-readable media comprising computer-executable instructions that, when executed, perform the method as recited in claim 41.

47. One or more semiconductor devices comprising digital circuits configured to perform the method as recited in claim 41.

48. A multi-channel audio decoder for initiating decoding of a lossless variable bit-rate (VBR) multi-channel audio bitstream at a random access point (RAP), wherein said decoder is configured to:

receive a lossless VBR multi-channel audio bitstream as a sequence of frames partitioned into a plurality of segments having a variable length frame payload and including at least one independently decodable and losslessly reconstructable channel set including a plurality of audio channels for a multi-channel audio signal, each frame comprising header information including segment duration, RAP parameters that indicate the existence and location of up to one RAP segment, navigation data, channel set header information including prediction coefficients for each said channel in each said channel set, and segment header information for each said channel set including at least one entropy code flag and at least one entropy coding parameter, and entropy coded compressed multi-channel audio signals stored in said number of segments, wherein the lossless VBR multi-channel audio bitstream is received and executed on a computing device;

unpack the header of the next frame in the bitstream to extract the RAP parameters until a frame having a RAP segment is detected;

unpack the header of the selected frame to extract the segment duration and navigation data to navigate to the beginning of the RAP segment;

unpack the header for the at least one said channel set to extract the entropy code flag and coding parameter and the entropy coded compressed multi-channel audio signals and perform an entropy decode on the RAP segment using the selected entropy code and coding parameter to generate compressed audio signals for the RAP segment; and unpack the header for the at least one said channel set to extract prediction coefficients and reconstruct the compressed audio signals to losslessly reconstruct PCM audio for each audio channel in said channel set for the RAP segment; and decode the remainder of the segments in the frame and subsequent frames in order.

49. The multi-channel audio decoder of claim 48, wherein the first audio samples of any RAP segment up to the prediction order are uncompressed, said decoder configured to disable prediction for the first audio samples up to the prediction order to losslessly reconstruct the PCM audio at the RAP segment to initiate decoding any thereafter as subsequent RAP segments are encountered.

50. A multi-channel audio decoder for decoding a lossless variable bit-rate (VBR) multi-channel audio bitstream, wherein said decoder is configured to:

receive a lossless VBR multi-channel audio bitstream as a sequence of frames partitioned into a plurality of segments having a variable length frame payload and including at least one independently decodable and losslessly reconstructable channel set including a plurality of audio channels for a multi-channel audio signal, each frame comprising header information including segment duration, channel set header information including transient parameters that indicate the existence and location of a transient segment in each channel, prediction coefficients for each said channel including a single set of frame-based prediction coefficients if no transient is present and first and second sets of partition-based prediction coefficients if a transient is present in each said channel set, and segment header information for each said channel set including at least one entropy code flag and at least one entropy coding parameter, and entropy coded compressed multi-channel audio signals stored in said number of segments, wherein the lossless VBR multi-channel audio bitstream is received and executed on a computing device;

unpack the header to extract the segment duration;

unpack the header for the at least one said channel set to extract the entropy code flag and coding parameter and the entropy coded compressed multi-channel audio signals for each segment and perform an entropy decode on each segment using the selected entropy code and coding parameter to generate compressed audio signals for each segment;

unpack the header for the at least one said channel set to extract the transient parameters to determine the existence and location of transient segments in each channel in the channel set;

unpack the header for the at least one said channel set to extract the single set of frame-based prediction coefficients or first and second sets of partition-based prediction coefficients for each channel depending on the existence of a transients; and for each channel in the channel set, applying either the single set of prediction coefficients to the compressed audio signals for all segments in the frame to losslessly reconstruct PCM audio or applying the first set of prediction coefficients to the compressed audio signals starting at the first segment and applying the second set of prediction coefficients to the compressed audio signals starting at the transient segment.

* * * * *